US009320311B2

(12) United States Patent
Szalkowski et al.

(10) Patent No.: US 9,320,311 B2
(45) Date of Patent: Apr. 26, 2016

(54) HELMET IMPACT LINER SYSTEM

(71) Applicant: Intellectual Property Holdings, LLC, Cleveland, OH (US)

(72) Inventors: Ron Szalkowski, Lakewood, OH (US); Joshua Schmidt, Lakewood, OH (US)

(73) Assignee: Intellectual Property Holdings, LLC, Cleveland, OH (US)

( * ) Notice: Subject to any disclaimer, the term of this patent is extended or adjusted under 35 U.S.C. 154(b) by 520 days.

(21) Appl. No.: 13/803,767

(22) Filed: Mar. 14, 2013

(65) Prior Publication Data

US 2013/0291289 A1 Nov. 7, 2013

Related U.S. Application Data

(60) Provisional application No. 61/641,619, filed on May 2, 2012.

(51) Int. Cl.
*A42B 3/00* (2006.01)
*A42B 3/12* (2006.01)

(52) U.S. Cl.
CPC ..... *A42B 3/12* (2013.01)

(58) Field of Classification Search
CPC ..... A42B 3/06; A42B 3/12; A42B 3/125; A42B 3/127
See application file for complete search history.

(56) References Cited

U.S. PATENT DOCUMENTS

| | | | |
|---|---|---|---|
| 666,130 | A | 1/1901 | Cole |
| 957,394 | A | 5/1910 | Thoma |
| 1,012,597 | A | 12/1911 | Church |
| 1,539,283 | A | 5/1925 | Staats-Oels |
| 1,552,965 | A | 9/1925 | Smith |
| 1,560,825 | A | 11/1925 | Kelticka |
| 1,958,050 | A | 5/1934 | Koppelman |
| 2,074,331 | A | 3/1937 | Haider |
| 2,090,881 | A | 8/1937 | Wilson |
| 2,221,310 | A | 11/1940 | Gazelle |
| 2,275,575 | A | 3/1942 | Vrooman |
| 2,285,335 | A | 6/1942 | Hurt |
| 2,303,744 | A | 12/1942 | Jacobs |

(Continued)

FOREIGN PATENT DOCUMENTS

| | | |
|---|---|---|
| CA | 2598015 | 8/2006 |
| CA | 2663728 | 9/2008 |

(Continued)

OTHER PUBLICATIONS

Office Action from U.S. Appl. No. 13/535,767 dated Sep. 2, 2015.

(Continued)

*Primary Examiner* — Richale Quinn
(74) *Attorney, Agent, or Firm* — Calfee, Halter & Griswold LLP

(57) ABSTRACT

The present application discloses a helmet, an impact liner system for a helmet, and energy management structures for a helmet. The helmet generally comprises a helmet shell and an impact liner system removably attached to the helmet shell. In certain embodiments, the impact liner system comprises a plurality of compressible energy management structures and one or more carriers for supporting the energy management structures within the helmet shell. The energy management structures are positioned between an interior surface of the helmet shell and the head of a user when the impact liner system is attached to the helmet shell.

26 Claims, 17 Drawing Sheets

(56) References Cited

U.S. PATENT DOCUMENTS 2,311,373 A 2/1943 Durning
2,318,077 A 5/1943 Jonas
2,346,161 A 4/1944 Grant
2,349,907 A 5/1944 Kos
2,433,012 A 12/1947 Zalicovitz
2,434,641 A 1/1948 Bums
2,711,033 A 6/1955 Dick
2,739,093 A 3/1956 Bull
2,759,186 A 8/1956 Dye
2,772,196 A 11/1956 Pooley
2,776,452 A 1/1957 Chavannes
2,983,056 A 5/1961 Murawski
3,018,015 A 1/1962 Agriss et al.
3,026,231 A 3/1962 Chavannes
3,039,109 A 6/1962 Simpson
3,086,899 A 4/1963 Smith et al.
3,088,539 A 5/1963 Mathues et al.
3,099,043 A 7/1963 Held
3,124,807 A 3/1964 Frenkel et al.
3,142,599 A 7/1964 Chavannes
3,144,247 A 8/1964 Szonn et al.
3,153,792 A 10/1964 Marietta
3,160,963 A 12/1964 Aaskov
3,186,013 A 6/1965 Glassman et al.
3,195,686 A 7/1965 Johnson
3,231,454 A * 1/1966 Williams ..... B65D 81/03 206/521
3,242,500 A 3/1966 Derr
3,251,076 A 5/1966 Burke
3,280,410 A 10/1966 Propst et al.
3,327,334 A 6/1967 Wilmanns et al.
3,342,666 A 9/1967 Hull
3,366,971 A 2/1968 Scherz
3,378,888 A 4/1968 Robertson
3,425,061 A 2/1969 Webb
3,447,163 A 6/1969 Bothwell et al.
3,484,835 A 12/1969 Trountine et al.
3,500,472 A 3/1970 Castellani
3,500,475 A 3/1970 Otsuka
3,507,727 A 4/1970 Marshack
3,508,992 A 4/1970 Chavannes et al.
3,514,156 A 5/1970 Fields
3,525,663 A 8/1970 Hale
3,538,628 A 11/1970 Einstein, Jr.
3,575,781 A 4/1971 Pezely
3,600,714 A 8/1971 Cade
3,608,215 A 9/1971 Fukuoka
3,609,764 A 10/1971 Morgan
3,618,144 A 11/1971 Frey et al.
3,633,228 A 1/1972 Zysman
3,668,056 A 6/1972 Hayes, Jr.
3,668,704 A 6/1972 Conroy
3,673,609 A 7/1972 De Simone
3,679,166 A 7/1972 Sturhan
3,684,235 A 8/1972 Schupbach
3,709,967 A 1/1973 Held, Jr.
3,713,640 A 1/1973 Margan
3,716,614 A 2/1973 Okamoto et al.
3,729,744 A 5/1973 Rappleyea
3,747,968 A 7/1973 Hornsby
3,761,959 A 10/1973 Dunning
3,766,669 A 10/1973 Pearsall
3,782,767 A 1/1974 Moore
3,783,450 A 1/1974 O'Connor
3,784,985 A 1/1974 Conroy
3,806,950 A 4/1974 Spencer-Foote
3,837,991 A 9/1974 Evans
3,844,862 A 10/1974 Sauer et al.
3,849,801 A 11/1974 Holt et al.
3,853,221 A 12/1974 Boyd
3,857,144 A 12/1974 Bustin
3,863,909 A 2/1975 Weber
3,871,636 A 3/1975 Boyle
3,872,511 A * 3/1975 Nichols ..... A42B 3/121 2/413
3,877,076 A 4/1975 Summers
3,882,547 A 5/1975 Morgan
3,895,456 A 7/1975 Fabre
3,900,222 A 8/1975 Muller
3,911,187 A 10/1975 Raley
3,926,463 A 12/1975 Landwehr
3,928,881 A 12/1975 Bente
3,933,387 A 1/1976 Salloum et al.
3,940,529 A 2/1976 Hepford et al.
3,940,811 A 3/1976 Tomikawa et al.
3,952,358 A 4/1976 Fukuoka
3,971,583 A 7/1976 Kornhauser
D241,228 S 8/1976 Boduch
3,994,020 A 11/1976 Villari
3,995,901 A 12/1976 Filbert, Jr. et al.
3,997,207 A 12/1976 Norlin
3,999,220 A 12/1976 Keltner
4,022,505 A 5/1977 Saczawa, Jr.
4,023,213 A 5/1977 Rovani
4,029,350 A 6/1977 Goupy et al.
4,029,534 A 6/1977 Bocks et al.
4,038,700 A 8/1977 Gyory
4,044,399 A 8/1977 Morton
4,044,479 A 8/1977 Brutting
4,064,565 A 12/1977 Griffiths
4,067,063 A 1/1978 Ettinger
4,075,717 A 2/1978 Lemelson
4,077,393 A 3/1978 Mattson
4,099,759 A 7/1978 Kornhauser
4,101,983 A 7/1978 Dera et al.
4,106,745 A 8/1978 Carrow
4,110,857 A 9/1978 Banister
4,114,197 A 9/1978 Morton
4,134,156 A 1/1979 Gyory
4,151,661 A 5/1979 Namba
4,154,469 A 5/1979 Goupy et al.
4,154,489 A 5/1979 Lyman
4,170,078 A 10/1979 Moss
4,187,620 A 2/1980 Selner
4,190,276 A 2/1980 Hirano
4,192,699 A 3/1980 Lewicki et al.
4,213,202 A 7/1980 Larry
4,223,455 A 9/1980 Vermeulen
4,223,456 A 9/1980 Cohen
4,236,326 A 12/1980 Inohara
4,239,106 A * 12/1980 Aileo ..... A42C 2/007 2/414
4,239,476 A 12/1980 Somberg
4,251,932 A 2/1981 Love
4,262,433 A 4/1981 Hagg
4,267,648 A 5/1981 Weisz
4,279,038 A 7/1981 Bruckner et al.
4,287,613 A 9/1981 Schulz
4,288,399 A 9/1981 Siedenstrang et al.
4,290,149 A 9/1981 Aileo
4,297,797 A 11/1981 Meyers
4,299,038 A 11/1981 Epple
4,302,892 A 12/1981 Adamik
4,305,212 A 12/1981 Coomer
4,307,471 A 12/1981 Lovell
4,321,989 A 3/1982 Meinzer
4,338,371 A 7/1982 Dawn et al.
4,342,157 A 8/1982 Gilbert
4,342,158 A 8/1982 McMahon
4,345,338 A 8/1982 Frieder, Jr. et al.
4,347,637 A 9/1982 Ardito
4,352,484 A 10/1982 Gertz
4,355,792 A 10/1982 Fukuda
4,356,642 A 11/1982 Herman
D267,287 S 12/1982 Gooding
D267,831 S 2/1983 Sucato
4,370,754 A 2/1983 Donzis
4,372,058 A 2/1983 Stubblefield
4,377,042 A 3/1983 Bauer
4,391,048 A 7/1983 Lutz
4,398,357 A 8/1983 Batra
4,400,483 A 8/1983 Siedenstrang et al.
4,400,894 A 8/1983 Ehrlich
4,413,856 A 11/1983 McMahan et al.

(56) References Cited

U.S. PATENT DOCUMENTS 4,418,483 A 12/1983 Fujita
4,423,000 A 12/1983 Teraoka
4,428,306 A 1/1984 Dresen et al.
4,432,099 A 2/1984 Grick et al.
4,439,936 A 4/1984 Clarke et al.
4,445,283 A 5/1984 Meyers
4,449,307 A 5/1984 Stubblefield
4,453,271 A 6/1984 Donzis
4,455,765 A 6/1984 Sjosward
4,458,430 A 7/1984 Peterson
4,460,205 A 7/1984 Glance
4,472,472 A 9/1984 Schultz
4,494,320 A 1/1985 Davis
4,497,123 A 2/1985 Ehrlich
4,510,702 A 4/1985 Ehrlich, Jr.
4,513,449 A 4/1985 Donzis
4,518,643 A 5/1985 Francis
4,523,393 A 6/1985 Inohara
4,534,068 A 8/1985 Mitchell et al.
4,535,553 A 8/1985 Derderian et al.
4,538,301 A 9/1985 Sawatzki et al.
4,538,366 A 9/1985 Norton
4,546,555 A 10/1985 Spademan
4,553,342 A 11/1985 Derderian et al.
4,558,470 A 12/1985 Mitchell et al.
4,562,651 A 1/1986 Frederick et al.
4,566,137 A 1/1986 Gooding
4,566,678 A 1/1986 Anderson
4,578,296 A 3/1986 Miyazaki
4,586,200 A 5/1986 Poon
4,601,367 A 7/1986 Bongers
4,614,000 A * 9/1986 Mayer ..... A61F 13/00 428/156
4,616,431 A 10/1986 Dassler
4,619,055 A 10/1986 Davidson
4,624,061 A 11/1986 Wezel et al.
4,627,114 A 12/1986 Mitchell
4,631,221 A 12/1986 Disselbeck et al.
4,635,384 A 1/1987 Huh et al.
4,635,981 A 1/1987 Friton
4,642,814 A 2/1987 Godfrey
4,657,716 A 4/1987 Schmidt
4,666,130 A 5/1987 Denman
4,667,423 A 5/1987 Autry et al.
4,670,995 A 6/1987 Huang
4,672,754 A 6/1987 Ehrlich
4,676,010 A 6/1987 Cheskin
4,680,875 A 7/1987 DAnieli
4,695,496 A 9/1987 Lee
4,700,403 A 10/1987 Vacanti
4,704,746 A 11/1987 Nava
4,710,984 A 12/1987 Asper
4,720,261 A 1/1988 Fishwick et al.
4,722,131 A 2/1988 Huang
4,724,549 A 2/1988 Herder et al.
4,730,402 A 3/1988 Norton et al.
4,739,762 A 4/1988 Palmaz
4,741,114 A 5/1988 Stubblefield
4,753,021 A 6/1988 Cohen
4,759,136 A 7/1988 Stewart et al.
4,763,426 A 8/1988 Polus et al.
4,766,614 A 8/1988 Cantwell et al.
4,768,295 A 9/1988 Ito
4,798,009 A 1/1989 Colonel et al.
4,808,469 A 2/1989 Hiles
4,815,221 A 3/1989 Diaz
4,817,304 A 4/1989 Parker et al.
4,823,483 A 4/1989 Chapnick
4,831,750 A 5/1989 Muller
4,838,606 A 6/1989 Furubayashi et al.
4,842,931 A 6/1989 Zook
4,843,741 A 7/1989 Yung-Mao
4,844,213 A 7/1989 Travis
4,845,786 A 7/1989 Chiarella
4,845,861 A 7/1989 Moumdjian
4,845,863 A 7/1989 Yung-Mao
4,852,704 A 8/1989 Brockenbrough
4,853,980 A 8/1989 Zarotti
4,856,208 A 8/1989 Zaccaro
4,856,833 A 8/1989 Beekman
4,858,343 A 8/1989 Flemming
4,858,606 A 8/1989 Hamlin
4,872,220 A 10/1989 Haruvy et al.
4,876,053 A 10/1989 Norton
4,883,299 A 11/1989 Bonar
4,887,369 A 12/1989 Bailey
4,890,877 A 1/1990 Ashtiani-Zarandi et al.
4,899,467 A 2/1990 Mackey
4,901,987 A 2/1990 Greenhill et al.
4,904,008 A 2/1990 Glance
4,905,382 A 3/1990 Yung-Mao
4,909,661 A 3/1990 Ivey
4,912,861 A 4/1990 Huang
4,916,759 A 4/1990 Arai
4,918,841 A 4/1990 Turner
4,920,663 A 5/1990 Flemming
4,922,630 A 5/1990 Robinson
4,922,631 A 5/1990 Anderie
4,923,650 A 5/1990 Antoon, Jr. et al.
4,925,224 A 5/1990 Smiszek
4,930,231 A 6/1990 Liu
4,931,115 A 6/1990 Pajunen
4,934,071 A 6/1990 Virgini
4,941,701 A 7/1990 Loren
4,951,986 A 8/1990 Hanafusa et al.
D310,893 S 9/1990 Broersma
4,969,680 A 11/1990 Shimoda
4,970,729 A 11/1990 Shimazaki
4,972,611 A 11/1990 Swartz
4,984,320 A 1/1991 Curley, Jr. et al.
4,987,609 A 1/1991 Zahn
4,993,173 A 2/1991 Gardener
4,999,931 A 3/1991 Vermeulen
5,011,642 A 4/1991 Welygan et al.
5,014,449 A 5/1991 Richard et al.
5,014,691 A 5/1991 Cueman et al.
5,016,417 A 5/1991 Mentken
5,025,504 A 6/1991 Benston et al.
5,027,803 A 7/1991 Scholz et al.
5,030,501 A 7/1991 Colvin et al.
5,033,593 A 7/1991 Kazuhito
5,035,009 A 7/1991 Wingo, Jr. et al.
5,035,758 A 7/1991 Degler et al.
5,042,174 A 8/1991 Nichols
5,042,175 A 8/1991 Ronen et al.
5,042,176 A 8/1991 Rudy
5,042,859 A 8/1991 Zhang et al.
5,044,096 A 9/1991 Polegato
5,046,267 A 9/1991 Kilgore et al.
5,048,203 A 9/1991 Kling
5,056,162 A 10/1991 Tirums
5,058,212 A 10/1991 Kamata
5,066,400 A 11/1991 Rocklitz et al.
5,068,922 A 12/1991 Zahn
5,083,320 A 1/1992 Halstead
5,083,361 A 1/1992 Rudy
5,086,033 A 2/1992 Armor et al.
5,092,060 A 3/1992 Frachey et al.
5,093,938 A 3/1992 Kamata
5,097,607 A 3/1992 Fredericksen
5,098,124 A 3/1992 Breed et al.
5,124,191 A 6/1992 Seksaria
5,131,174 A 7/1992 Drew et al.
5,150,935 A 9/1992 Glance et al.
5,165,990 A 11/1992 Nakano
5,168,576 A 12/1992 Krent et al.
5,175,889 A 1/1993 Infusino
5,204,998 A 4/1993 Liu
5,224,277 A 7/1993 Sang Do
5,235,715 A 8/1993 Donzis
5,244,745 A * 9/1993 Seksaria ..... B62D 25/02 428/593
5,263,203 A 11/1993 Kraemer et al.
5,271,103 A 12/1993 Darnell

(56) References Cited

U.S. PATENT DOCUMENTS 5,274,846 A 1/1994 Kolsky
5,280,890 A 1/1994 Wydra
5,282,288 A 2/1994 Henson
5,324,460 A 6/1994 Briggs
5,330,249 A 7/1994 Weber et al.
5,376,318 A 12/1994 Ho
5,409,200 A 4/1995 Zingher et al.
5,421,035 A 6/1995 Klose et al.
5,423,087 A 6/1995 Krent et al.
5,439,733 A 8/1995 Paire
D364,487 S 11/1995 Tutton et al.
5,477,558 A 12/1995 Volker et al.
5,493,791 A 2/1996 Kramer
5,543,194 A 8/1996 Rudy
5,545,128 A 8/1996 Hayes
5,555,584 A 9/1996 Moore et al.
5,572,804 A 11/1996 Skaja et al.
5,581,818 A 12/1996 Lorenzi et al.
5,588,165 A 12/1996 Fromme
5,591,379 A 1/1997 Shores
5,595,003 A 1/1997 Snow
5,598,588 A 2/1997 Lee
5,611,153 A 3/1997 Fisher et al.
5,655,226 A 8/1997 Williams
5,669,079 A 9/1997 Morgan
5,734,994 A 4/1998 Rogers
5,741,568 A 4/1998 Rudy
5,766,704 A 6/1998 Allen et al.
5,891,372 A 4/1999 Besset et al.
5,913,412 A 6/1999 Huber et al.
5,946,734 A 9/1999 Vogan
5,950,244 A 9/1999 Fournier et al.
D415,420 S 10/1999 Chen
5,976,451 A 11/1999 Skaja et al.
5,992,054 A 11/1999 Rauch
5,996,126 A 12/1999 Barthold et al.
6,029,962 A 2/2000 Shorten et al.
6,051,624 A 4/2000 Bastin et al.
6,070,271 A 6/2000 Williams
6,085,878 A 7/2000 Araki et al.
6,093,468 A 7/2000 Toms et al.
6,098,313 A 8/2000 Skaja
6,105,162 A 8/2000 Douglas et al.
6,105,176 A 8/2000 Egger
6,108,825 A 8/2000 Bell et al.
6,154,889 A 12/2000 Moore, III et al.
6,199,942 B1 3/2001 Carroll et al.
6,219,850 B1 4/2001 Halstead et al.
6,226,801 B1 5/2001 Alexander
6,247,745 B1 6/2001 Carroll et al.
6,298,497 B1 10/2001 Chartrand
6,326,077 B1 12/2001 Monaci
6,351,854 B1 3/2002 Whalen et al.
6,353,953 B1 3/2002 Tanaka et al.
6,378,140 B1 * 4/2002 Abraham ..... A42B 3/064 2/411
6,381,759 B1 5/2002 Katz
6,383,431 B1 5/2002 Dobrin et al.
6,391,935 B1 5/2002 Hager et al.
6,425,141 B1 7/2002 Ewing et al.
6,434,755 B1 8/2002 Halstead et al.
6,443,513 B1 9/2002 Glance
6,446,270 B1 9/2002 Durr
6,453,476 B1 9/2002 Moore, III
6,457,261 B1 10/2002 Crary
6,460,207 B1 10/2002 Papay et al.
6,467,099 B2 10/2002 Dennis et al.
6,485,446 B1 11/2002 Brother et al.
6,499,147 B2 12/2002 Schiebl et al.
6,532,602 B2 3/2003 Watters et al.
6,533,258 B2 3/2003 Monson et al.
6,536,052 B2 3/2003 Tao et al.
6,550,850 B2 4/2003 Laborie et al.
D475,486 S 6/2003 Ide et al.
6,604,246 B1 8/2003 Obreja
6,634,045 B1 10/2003 DuDonis et al.
6,658,671 B1 12/2003 Von Holst et al.
6,671,889 B2 1/2004 Dennis et al.
6,679,544 B1 1/2004 Hubbert et al.
6,679,967 B1 1/2004 Carroll, III et al.
6,681,409 B2 1/2004 Dennis et al.
6,682,128 B2 1/2004 Carroll, III et al.
D491,695 S 6/2004 Long
6,752,450 B2 6/2004 Carroll, III et al.
D492,818 S 7/2004 Ide et al.
D495,096 S 8/2004 Long
6,803,005 B2 10/2004 Dennis et al.
6,926,947 B1 8/2005 Seckel
6,994,333 B2 2/2006 Lobry et al.
D521,191 S 5/2006 Berger
D523,180 S 6/2006 Frye
7,078,443 B2 7/2006 Milliren
7,228,648 B2 * 6/2007 Yang ..... A43B 3/24 36/27
7,240,376 B2 7/2007 Ide et al.
7,255,910 B1 8/2007 Seckel
7,299,505 B2 11/2007 Dennis et al.
7,316,036 B2 1/2008 Rudolf et al.
7,338,038 B2 3/2008 Maurer et al.
7,341,776 B1 3/2008 Milliren et al.
7,360,822 B2 4/2008 Carroll, III et al.
D570,055 S 5/2008 Ferrara et al.
7,377,577 B2 5/2008 Carroll, III et al.
7,384,095 B2 6/2008 Cormier
7,404,593 B2 7/2008 Cormier
D577,866 S 9/2008 Frye et al.
D581,599 S 11/2008 Ferrara et al.
D582,607 S 12/2008 Ferrara et al.
7,458,172 B2 * 12/2008 Aveni ..... A43B 13/183 267/144
7,464,414 B2 12/2008 McDuff
D584,456 S 1/2009 Ferrara
7,513,344 B2 4/2009 Toccalino
7,574,760 B2 8/2009 Foley et al.
D603,103 S 10/2009 Ferrara et al.
7,603,725 B2 10/2009 Harris
7,625,023 B2 12/2009 Audi et al.
D608,688 S 1/2010 Dalzell et al.
7,673,351 B2 3/2010 Copeland et al.
7,676,854 B2 3/2010 Berger et al.
7,677,538 B2 3/2010 Darnell et al.
D617,503 S 6/2010 Szalkowski
7,730,635 B2 6/2010 Aveni et al.
D621,099 S 8/2010 Johnson et al.
D622,449 S 8/2010 Culley et al.
7,774,866 B2 * 8/2010 Ferrara ..... A42B 3/121 2/455
7,802,320 B2 9/2010 Morgan
7,857,610 B2 12/2010 Rossi et al.
7,866,248 B2 1/2011 Moore et al.
7,895,681 B2 3/2011 Ferrara
D637,356 S 5/2011 Green et al.
7,950,073 B2 5/2011 Ferrara
D640,422 S 6/2011 Green et al.
7,959,023 B2 6/2011 Ferrara
7,960,473 B2 6/2011 Kobayashi et al.
8,039,078 B2 10/2011 Moore et al.
8,047,602 B2 11/2011 Sielhorst et al.
8,056,972 B2 * 11/2011 Marsden ..... B60N 2/2884 297/216.1
8,069,498 B2 12/2011 Maddux et al.
8,087,187 B2 1/2012 Aveni et al.
8,104,593 B2 1/2012 Lin
D655,051 S 2/2012 O'Keefe et al.
8,201,269 B2 * 6/2012 Maddux ..... A42B 3/127 2/424
8,205,272 B2 6/2012 Green
D663,076 S 7/2012 Parsons et al.
8,220,072 B2 7/2012 Dodd
D665,663 S 8/2012 Krupa
D666,779 S 9/2012 Harris
8,298,648 B2 * 10/2012 Turner ..... A41D 13/05 2/16
8,348,031 B2 1/2013 Smaldone et al.

(56) References Cited

U.S. PATENT DOCUMENTS

| | | | | |
|---|---|---|---|---|
| D679,058 | S | 3/2013 | Szalkowski | |
| 8,387,164 | B2 | 3/2013 | Maddux et al. | |
| 8,399,085 | B2 | 3/2013 | Moore et al. | |
| 8,544,117 | B2 * | 10/2013 | Erb | A42B 3/122 2/410 |
| 8,561,214 | B2 * | 10/2013 | Turner | A41D 13/0156 2/227 |
| 8,590,869 | B2 | 11/2013 | Tavares et al. | |
| 8,702,895 | B2 * | 4/2014 | Turner | A41D 13/0156 156/297 |
| 8,713,719 | B2 | 5/2014 | Turner | |
| 8,726,424 | B2 * | 5/2014 | Thomas | A42B 3/124 2/414 |
| 8,863,320 | B2 * | 10/2014 | Kelly | A42B 3/122 2/413 |
| 8,950,735 | B2 * | 2/2015 | Reynolds | F16F 1/376 2/413 |
| 9,131,744 | B2 * | 9/2015 | Erb | A42B 3/124 |
| 2002/0017805 | A1 | 2/2002 | Carroll, III et al. | |
| 2002/0120978 | A1 | 9/2002 | Moore | |
| 2002/0152542 | A1 | 10/2002 | Dennis et al. | |
| 2002/0163114 | A1 * | 11/2002 | Lobry | A47C 23/002 267/142 |
| 2002/0168496 | A1 | 11/2002 | Morimoto et al. | |
| 2003/0200677 | A1 * | 10/2003 | Abraham | A42B 3/124 36/27 |
| 2003/0217483 | A1 | 11/2003 | Abraham | |
| 2003/0230866 | A1 | 12/2003 | Lee | |
| 2004/0128860 | A1 * | 7/2004 | Smaldone | A43B 1/0072 36/28 |
| 2004/0139531 | A1 | 7/2004 | Moore et al. | |
| 2004/0154191 | A1 | 8/2004 | Park | |
| 2004/0188898 | A1 | 9/2004 | Siefermann et al. | |
| 2004/0199981 | A1 | 10/2004 | Tucker | |
| 2004/0200094 | A1 | 10/2004 | Baychar | |
| 2005/0050617 | A1 | 3/2005 | Moore et al. | |
| 2005/0166302 | A1 | 8/2005 | Dennis | |
| 2005/0196592 | A1 | 9/2005 | Tao et al. | |
| 2005/0268383 | A1 | 12/2005 | Harris | |
| 2006/0059605 | A1 | 3/2006 | Ferrara | |
| 2006/0059606 | A1 | 3/2006 | Ferrara | |
| 2006/0064900 | A1 | 3/2006 | Aveni | |
| 2006/0070170 | A1 | 4/2006 | Copeland et al. | |
| 2006/0101559 | A1 | 5/2006 | Moore et al. | |
| 2006/0177635 | A1 | 8/2006 | Pepe et al. | |
| 2007/0000032 | A1 | 1/2007 | Morgan | |
| 2007/0083965 | A1 | 4/2007 | Darnell et al. | |
| 2007/0190292 | A1 * | 8/2007 | Ferrara | A42B 3/121 428/166 |
| 2007/0190293 | A1 * | 8/2007 | Ferrara | B29C 45/0053 428/166 |
| 2007/0281125 | A1 | 12/2007 | Moore, III et al. | |
| 2008/0035442 | A1 | 2/2008 | Spingler | |
| 2008/0036242 | A1 | 2/2008 | Glance et al. | |
| 2008/0155735 | A1 | 7/2008 | Ferrara | |
| 2008/0166524 | A1 | 7/2008 | Skaja et al. | |
| 2008/0236378 | A1 | 10/2008 | Sane et al. | |
| 2008/0256686 | A1 | 10/2008 | Ferrara | |
| 2008/0307568 | A1 | 12/2008 | Sajic | |
| 2009/0038055 | A1 | 2/2009 | Ferrara | |
| 2009/0106882 | A1 | 4/2009 | Nimmons et al. | |
| 2009/0114083 | A1 | 5/2009 | Moore et al. | |
| 2009/0178184 | A1 | 7/2009 | Brine, III et al. | |
| 2009/0179361 | A1 | 7/2009 | Vito et al. | |
| 2009/0210998 | A1 | 8/2009 | Rolla | |
| 2009/0222975 | A1 | 9/2009 | Green et al. | |
| 2009/0265841 | A1 | 10/2009 | Ferrara | |
| 2009/0289026 | A1 | 11/2009 | Ferrara | |
| 2010/0000009 | A1 | 1/2010 | Morgan | |
| 2010/0037482 | A1 | 2/2010 | Litchfield et al. | |
| 2010/0129573 | A1 * | 5/2010 | Kim | A41D 31/005 428/34.1 |
| 2010/0186150 | A1 * | 7/2010 | Ferrara | A42B 3/128 2/412 |
| 2010/0258988 | A1 | 10/2010 | Darnell et al. | |
| 2010/0264571 | A1 | 10/2010 | Tarazona De La Asuncion et al. | |
| 2010/0273944 | A1 | 10/2010 | Kobayashi et al. | |
| 2010/0295221 | A1 | 11/2010 | Kligerman et al. | |
| 2010/0295270 | A1 * | 11/2010 | Marsden | B60N 2/2872 280/728.2 |
| 2010/0299812 | A1 * | 12/2010 | Maddux | A42B 3/124 2/414 |
| 2010/0299813 | A1 | 12/2010 | Morgan | |
| 2011/0004971 | A1 | 1/2011 | Benderradji | |
| 2011/0047678 | A1 | 3/2011 | Barth et al. | |
| 2011/0047685 | A1 * | 3/2011 | Ferrara | A42B 3/063 2/455 |
| 2011/0061154 | A1 * | 3/2011 | Turner | A41D 13/0156 2/455 |
| 2011/0074075 | A1 | 3/2011 | Henry et al. | |
| 2011/0107503 | A1 | 5/2011 | Morgan | |
| 2011/0131695 | A1 | 6/2011 | Maddux et al. | |
| 2011/0167542 | A1 | 7/2011 | Bayne et al. | |
| 2011/0198788 | A1 | 8/2011 | Hines | |
| 2011/0247744 | A1 * | 10/2011 | Turner | A41D 31/005 156/163 |
| 2011/0296594 | A1 * | 12/2011 | Thomas | A43B 3/124 2/414 |
| 2012/0017358 | A1 * | 1/2012 | Princip | A42B 3/064 2/414 |
| 2012/0036620 | A1 | 2/2012 | Harris | |
| 2012/0060251 | A1 | 3/2012 | Schimpf | |
| 2012/0079646 | A1 | 4/2012 | Belanger | |
| 2012/0174293 | A1 | 7/2012 | Milliren et al. | |
| 2013/0152287 | A1 | 6/2013 | Cormier et al. | |
| 2013/0153350 | A1 * | 6/2013 | Ferrara | F16F 1/376 188/376 |
| 2014/0325745 | A1 * | 11/2014 | Erb | A42B 3/127 2/414 |

FOREIGN PATENT DOCUMENTS

| | | |
|---|---|---|
| CA | 2681439 | 11/2008 |
| CA | 2696242 | 2/2009 |
| CN | 101227842 | 7/2008 |
| CN | 101627222 | 1/2010 |
| CN | 101707885 | 5/2010 |
| CN | 101720999 | 6/2010 |
| CN | 101873811 | 10/2010 |
| EP | 1685019 | 8/2006 |
| EP | 1848293 | 10/2007 |
| EP | 1927294 | 6/2008 |
| EP | 1937466 | 7/2008 |
| EP | 1848293 | 7/2009 |
| EP | 2092210 | 8/2009 |
| EP | 2132516 | 12/2009 |
| EP | 2146177 | 1/2010 |
| EP | 2180802 | 5/2010 |
| ES | 2330138 | 12/2009 |
| FR | 2717659 | 9/1995 |
| HK | 1112163 | 11/2009 |
| JP | 54-148845 | 11/1979 |
| SU | 659134 | 4/1979 |
| WO | 91/05489 | 5/1991 |
| WO | 2006/005189 | 1/2006 |
| WO | 2006/088500 | 8/2006 |
| WO | 2006/089098 | 8/2006 |
| WO | 2006/089235 | 8/2006 |
| WO | 2007/035800 | 3/2007 |
| WO | 2008011708 | 1/2008 |
| WO | 2008/105840 | 9/2008 |
| WO | 2008/140650 | 11/2008 |
| WO | 2009/020583 | 2/2009 |
| WO | 2009/134334 | 11/2009 |
| WO | 2010/087957 | 8/2010 |

OTHER PUBLICATIONS

The Messier Project: The M11 Helmet, 222.cascadeicehockey.com/the-helmet.html (2 pages) Jan. 19, 2010.

The Messier Project: the Technology, www.casecadeicehockey.com/the-technology.html, video slides of the Seven Technology, the video shows 80% compression (2 pages) Jan. 19, 2010.

(56) References Cited

OTHER PUBLICATIONS

Schutt Sports: Helmets—HotHead Technology, www.schuttsports.com/aspx/Sport/ProductCatalog.aspx?id-953 (1 page) Jan. 19, 2010.
Technology/SKYDEX, www.skydex.com/technology (3 pages) Jan. 19, 2010.
Blast Limiting/SKYDEX, www.skydex.com/technology/blast_limiting (7 pages) Jan. 19, 2010.
Impact Mitigation/SKYDEX, www.skydex.com/technology/impact_mitigation (7 pages) Jan. 19, 2010.
Manufacturing/SKYDEX, www.skydex.com/technology/manufacturing (2 pages) Jan. 19, 2010.
Development Process/SKYDEX, www.skydex.com/technology/development_process (2 pages) Jan. 19, 2010.
Selection Guide/SKYDEX, www.skydex.com/technology/selection_guide (3 pages) Jan. 19, 2010.
Patent Informaton/SKYDEX, 222.skydex.com/technology/patent (2 pages) Jan. 19, 2010.
Vs. Foam/SKYDEX, www.skydex.com/technology/vs_foam (1 page) Jan. 19, 2010.
Markets & Products/SKYDEX, www.skydex.com/markets_products (3 pages) Jan. 19, 2010.
Military Ballistic Helmet Pads/SKYDEX, www.skydex.com/helmet_pads (6 pages) Jan. 19, 2010.
Body Padding/SKYDEX, www. Wkydex.com/athletic./body_padding (1 page) Jan. 19, 2010.
International Search Report and Written Opinion for International Patent Application No. PCT/US11/38870 dated Oct. 26, 2011.
International Preliminary Report on Patentability for International Patent Application No. PCT/US11/38870 dated Dec. 4, 2012.
International Search Report and Written Opinion for International Patent Application No. PCT/US12/59474 dated Jan. 7, 2013.
Office Action from U.S. Appl. No. 12/792,858 dated Oct. 24, 2012.

* cited by examiner

HELMET IMPACT LINER SYSTEM

CROSS REFERENCE TO RELATED APPLICATIONS

This application is a U.S. Non-Provisional Patent Application which claims priority to U.S. Provisional Patent Application No. 61/641,619, filed on May 2, 2012 and titled "Helmet Impact Liner System," which is hereby incorporated by reference in its entirety.

BACKGROUND

Helmets generally include a shell and a liner. The helmet shell provides protection from protruding objects and is often configured to spread the impact load across the footprint of the helmet. The helmet liner is generally made of a softer and lower density material than the helmet shell. The helmet liner is often configured such that, upon impact, the helmet liner at least partially absorbs the impact energy from the force of an impact.

SUMMARY

The present application discloses a helmet, an impact liner system for a helmet, and energy management structures for a helmet. The helmet generally comprises a helmet shell and an impact liner system removably attached to the helmet shell. In certain embodiments, the impact liner system comprises a plurality of compressible energy management structures and one or more carriers for supporting the energy management structures within the helmet shell. The energy management structures are positioned between an interior surface of the helmet shell and the head of a user when the impact liner system is attached to the helmet shell. Each energy management structure comprises an outer wall and an inner wall substantially surrounded by the outer wall. The outer and inner walls are configured to bend when the exterior of the helmet shell is impacted by an object. The one or more carriers comprise a plurality of openings, each opening configured to receive an energy management structure. Further, the outer wall of the energy management structures extend between the interior of the helmet shell and the carrier of the impact liner system.

In certain embodiments, the energy management structures comprise a bottom portion and a top portion attached to the bottom portion. The bottom portion comprises a bottom wall and an outer wall extending from the bottom wall. The top portion comprises a top wall and inner wall extending from the top wall toward the bottom wall. The outer wall extends between the bottom wall and the top wall. Further, the energy management structure is configured to be positioned between the head of user and an interior surface of a helmet shell such that the top wall is adjacent the head of the user and the bottom wall is adjacent the interior surface. The outer and inner walls are configured to bend when an exterior of the helmet shell is impacted by an object.

These and additional embodiments will become apparent in the course of the following detailed description.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of the inventions.

DESCRIPTION OF EMBODIMENTS

Figure 1:
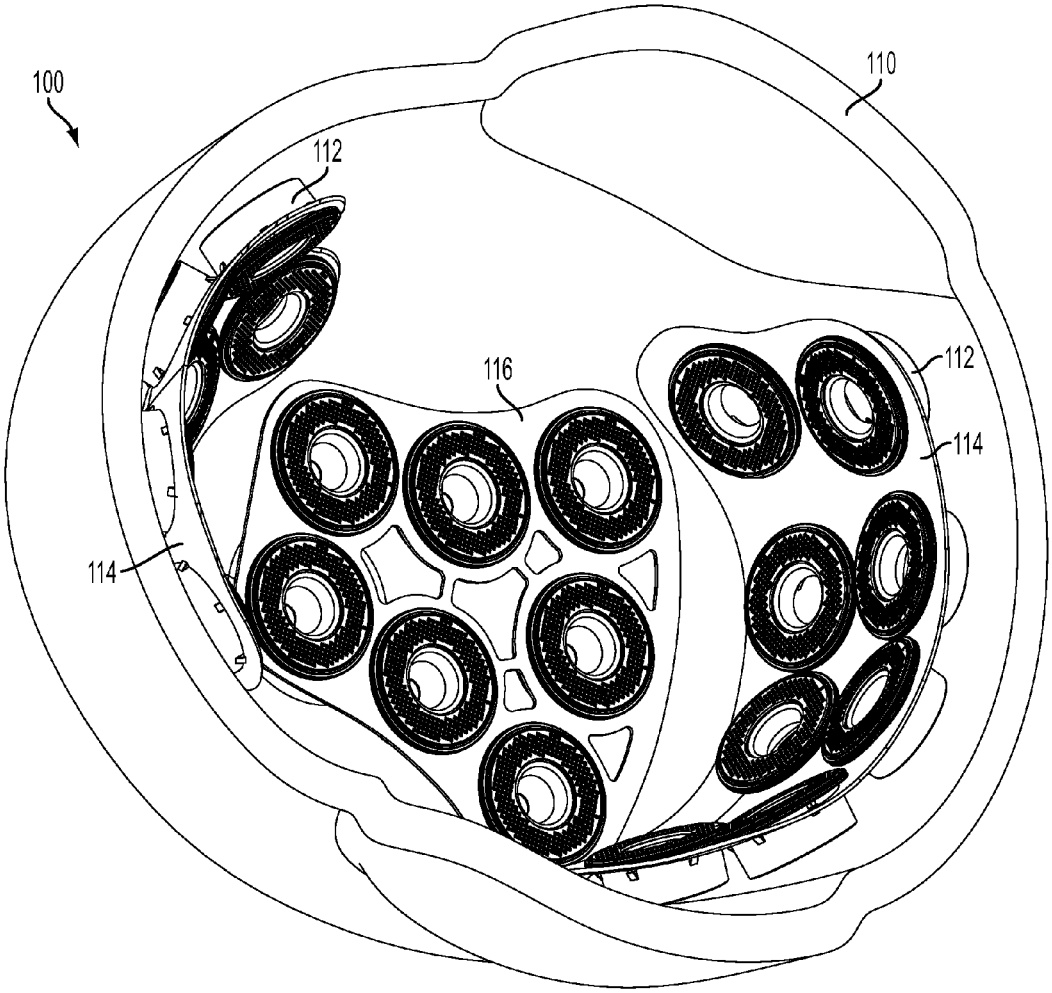
FIG. 1 is a perspective view of an impact liner system installed in a helmet shell according to an embodiment of the present application.

The present application discloses a helmet, an impact liner system for a helmet, and energy management structures for a helmet. The impact liner system generally comprises a plurality of compressible energy management structures that line the interior of the helmet shell and are positioned between the user's head and the helmet shell. In the embodiments disclosed herein, the impact liner system is described for use with a military helmet shell. Examples of such military helmet shells include a US Army Advanced Combat Helmet (ACH), a US Marine Corp Lightweight Helmet (LWH), an Enhanced Combat Helmet (ECH), a Personal Armor System for Ground Troops (PASGT) helmet, or other typical ballistic helmet shells.

However, the impact liner system of the present application may also be used with a variety of other helmets, including, but not limited to, sporting helmets, such as football, lacrosse, hockey, multi-sport, cycling, softball, or baseball helmets, or safety helmets, such as industrial or construction helmets. Additionally, the impact liner system of the present application may be used as an impact or energy management structure in a variety of other applications, such as, for example, vehicle or aircraft seating, vehicle occupant padding, and floor padding of workplace or recreational facilities. Furthermore, the impact liner of the present application may be used to protect other parts of the body.

During an impact event, the head of the user may experience peak accelerations or "g" forces. This may occur, for example, when the head comes to a sudden or violent stop within the helmet. The impact liner system of the present application is configured to manage the acceleration response of the user's head and minimize the amount of peak accelerations experienced by the user during an impact event. "Acceleration", as used herein, describes both acceleration and deceleration.

For example, the impact liner system of the present application may be configured to provide one or more stiffness responses such that the head of the user is gently accelerated to a stop. The one or more stiffness responses may be provided by a variety of different structures and/or materials of the impact liner system. The impact liner system may also be "tunable" to provide a range of stiffness responses. One exemplary method of "tuning" the impact liner system is to use various combinations of structures and materials for the components of the impact liner system. For example, structures and/or materials of a first portion of an energy management structure may differ from a second portion of the energy management structure. Further, the impact liner system may comprise one or more pads having a different stiffness response than the energy management structure.

The impact liner system of the present application may also comprise a carrier system for supporting and positioning the compressible energy management structures within the helmet shell. The energy management structures may be removably attached to the carrier system such that one or more of the energy management structures may be removed from the carrier system and replaced with a similar or different energy management structure. Further, the carrier system may also be removed from the helmet shell and replaced with a similar or different carrier system. As such, the impact liner system may be configured for use in a variety of different applications.

Figure 1A:
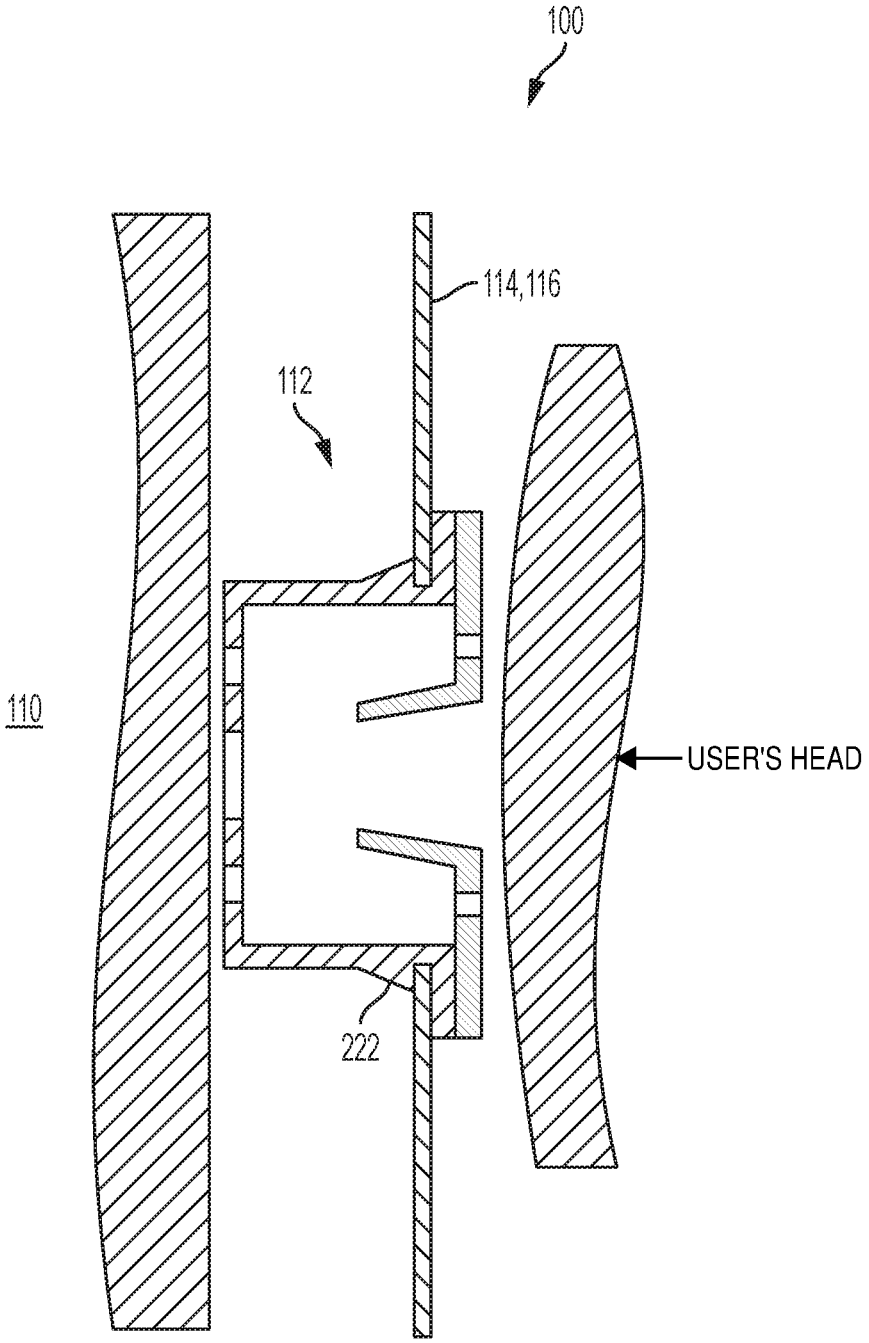
FIG. 1A is a schematic cross-sectional view of a portion of an impact liner system installed in a helmet shell according to an embodiment of the present application.

FIGS. 1 and 1A illustrate an impact liner system 100 according to an embodiment of the present invention. As shown, the impact liner system 100 is attached to the interior or backface of a helmet shell 110 and is configured to be positioned between the user's head and the helmet shell. The impact liner system 100 comprises a plurality of energy management structures 112 removably attached to one or more carriers 114 and 116. As illustrated in FIG. 1, the carriers 114 and 116 are configured such that the energy management structures 112 line the interior of a helmet shell 110, including the front, rear, crown and side portions of the helmet. The plurality of energy management structures 112 are configured to bend, buckle, crush, and/or otherwise deform upon impact to absorb and/or dissipate the impact energy from the force of the impact.

The carriers of the present application may be configured in a variety of ways to position the energy management structures at various locations and in various concentrations within the helmet shell. Carriers of various shapes, sizes, and opening layouts may be used to configure the impact liner system in variety of ways, such as for use in different helmets or to provide different amounts of coverage and spacing between the energy management structures. For example, the carriers of the impact liner system may be configured such that energy management structures are more concentrated at critical impact locations. Thus, the impact liner system may be reconfigured by simply using a different carrier layout.

FIGS. 2A-3B illustrate the carriers 114 and 116 of the impact liner system 100. Each carrier 114 and 116 comprises an array of openings configured to receive one or more energy management structures of the present application.

Figure 2A:
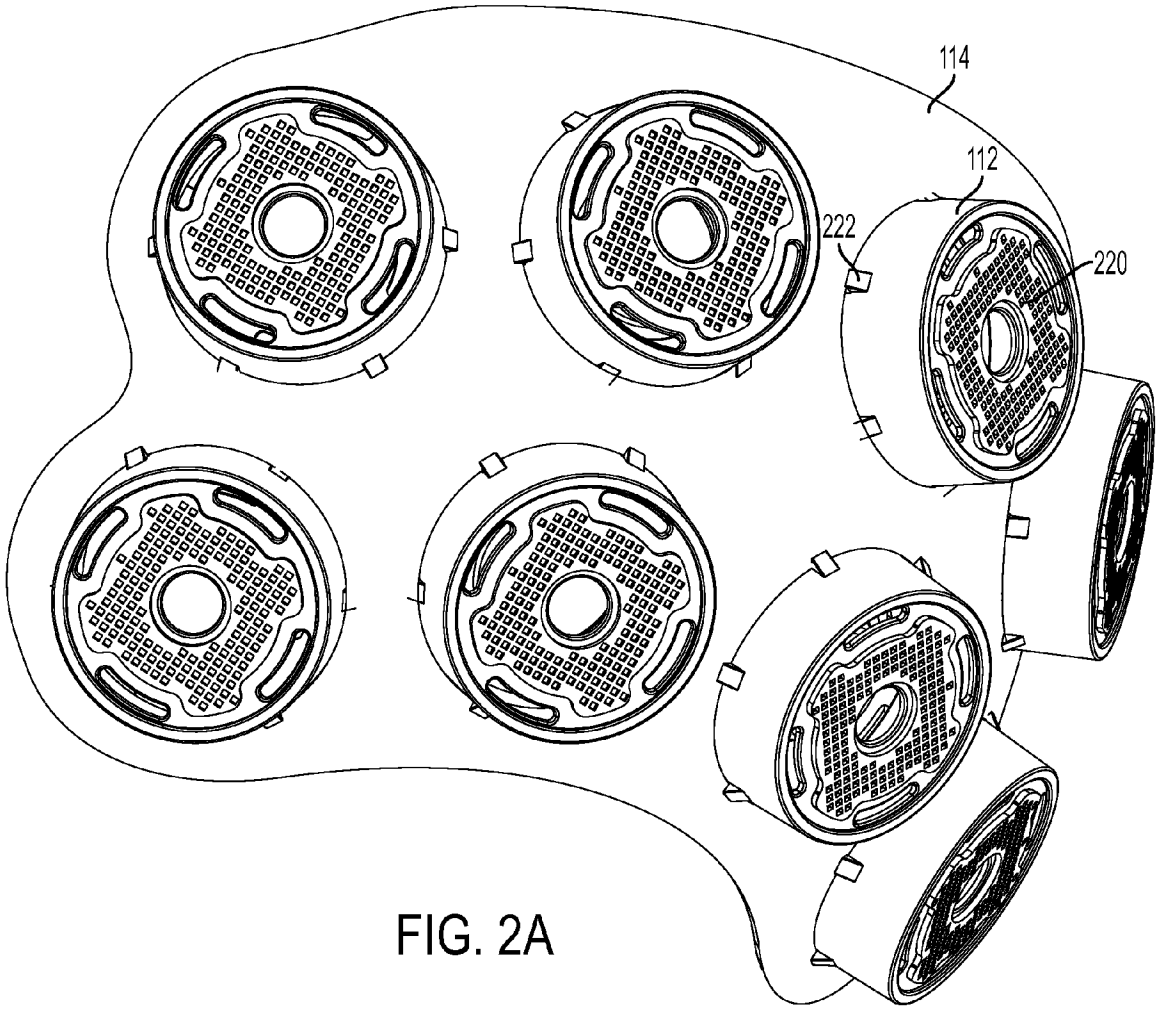
FIGS. 2A and 2B are perspective views of a carrier of the impact liner system of FIG. 1 according to an embodiment of the present application.
Figure 2B:
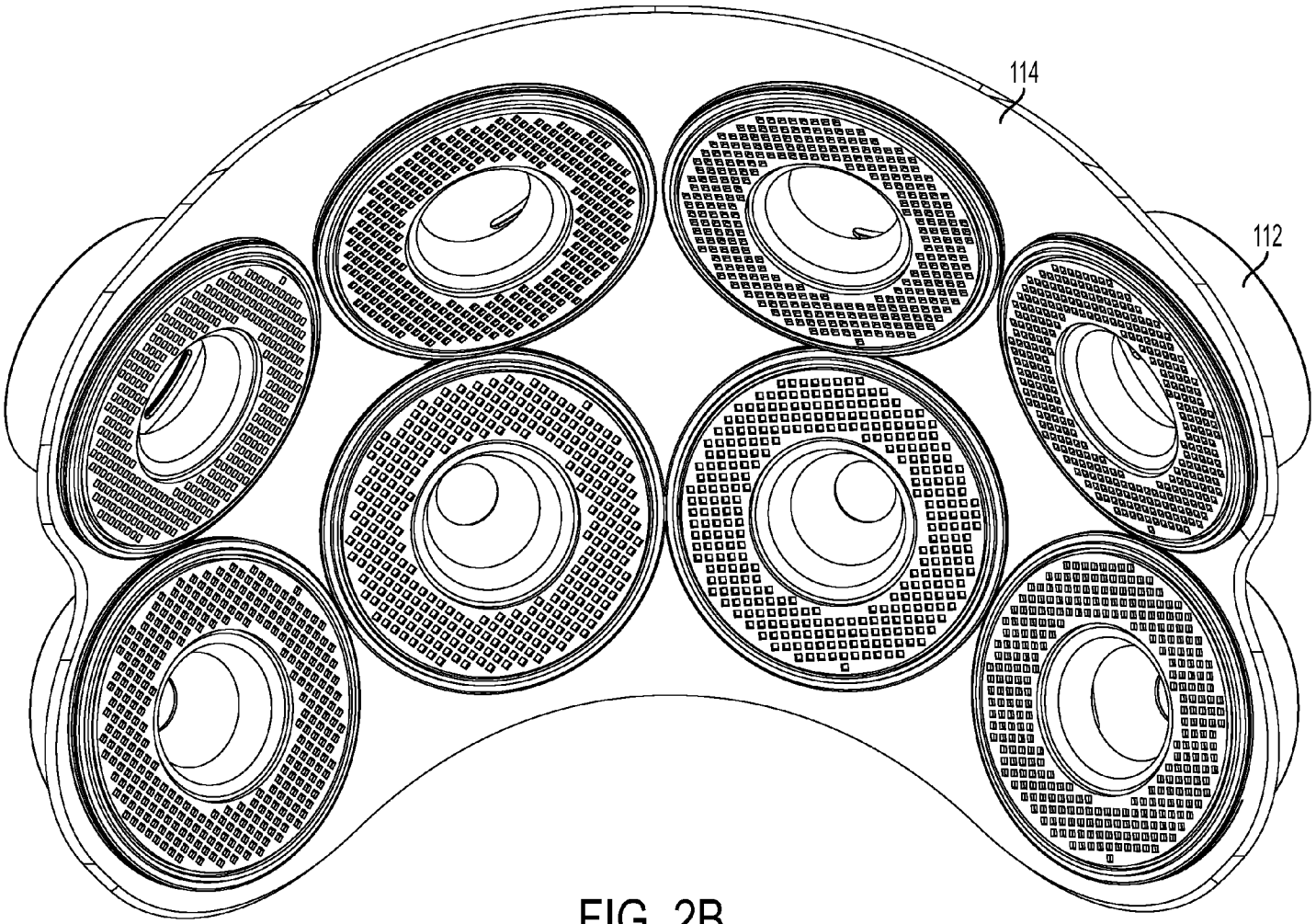
Figure 3B:
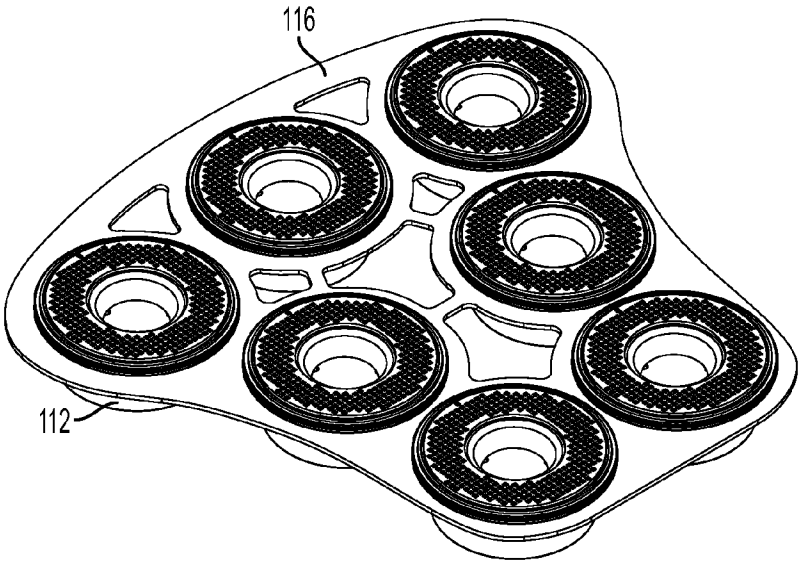
FIGS. 3A and 3B are perspective views of a carrier of the impact liner system of FIG. 1 according to an embodiment of the present application.
Figure 3A:
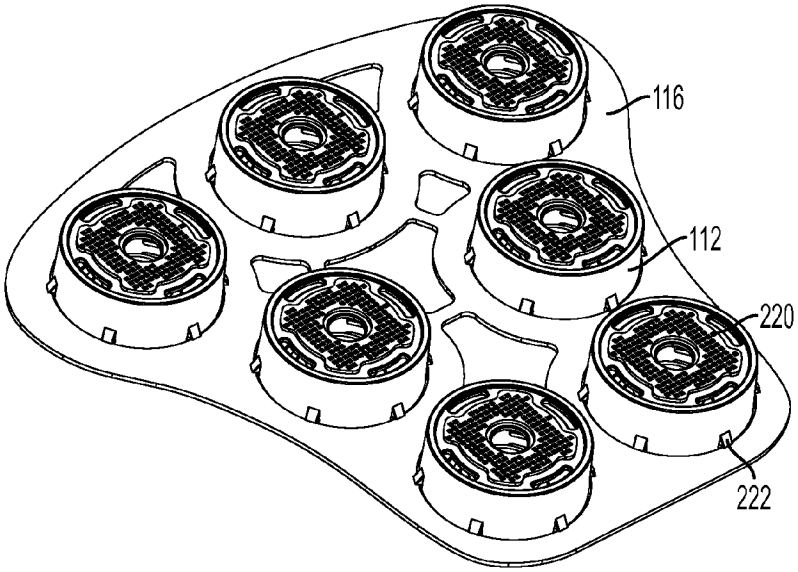

As illustrated in FIGS. 2A and 2B, the carrier 114 comprises twelve (8) openings in a 2×4 pattern and is curved to extend around the front and/or the rear of the helmet shell 110 and at least partially around the sides of the helmet shell. As such, the carrier 114 is sized and configured such that the energy management structures 112 line the portions of the helmet shell 110 corresponding to the front and side temple portions of the user's head and/or the rear and sides of the user's head. As illustrated in FIGS. 3A and 3B, the carrier 116 comprises seven (7) openings in a combined 1×3 and 2×2 pattern configured line the portion of the helmet shell 110 corresponding to the crown of the user's head.

As illustrated in FIG. 1, the impact liner system 100 is attached to the interior or backface of a helmet shell 110 by the energy management structures 112. As illustrated in FIGS. 2A-3B, the bottom of one or more of the energy management structures 112 comprises an attachment feature 220 for removably attaching the energy management structure and the corresponding carrier 114 and 116 to the interior or backface of the helmet shell 110. As shown, the attachment feature 220 is a piece of Velcro® (e.g., hook fabric or loop fabric) that is configured to mate with a corresponding piece of Velcro® (e.g., loop fabric or hook fabric) on the interior of the helmet shell 110 to removably attach the energy management structure 112 and the corresponding carrier 114 and 116 to the helmet shell. However, a wide variety of other attachment features may be used to attach one or more of the energy management structures 112 to the interior of the helmet shell 110. Examples of attachment features that may be used include, but are not limited to, one or more fasteners, adhesive, clips, pins, snaps, tape, buckles, hook and loop, or pin and slot. Further, in certain embodiments, one or more of the energy management structures 112 are attached to the interior of the helmet shell 110 with the attachment feature 220 but without being attached to a carrier 114 and 116 of the impact liner system 100 and/or without being connected to another energy management structure.

In certain embodiments, the carriers of the impact liner system may be removably attached to the helmet shell. For example, one or more of the carriers may comprise features or bosses with openings for attachment of the carrier to the helmet shell. In one exemplary embodiment, one or more of the carriers comprise a flanged portion extending from the carrier that is shaped and configured to facilitate attachment of the carrier to the helmet shell. The flanged portions may comprise one or more attachment features, such as, for example, one or more fasteners, adhesive, clips, pins, snaps, tape, buckles, Velcro®, or a hook and loop, used to attach the flanged portion to the helmet shell. It should be understood that the bosses and flanged portions of the carriers described herein are exemplary and the carriers may be configured in a variety of other ways to be removably attached to the interior of the helmet shell. For example, the carriers may be installed in the interior of the helmet shell with one or more fasteners, adhesive, weld, clips, pins, snaps, tape, buckles, Velcro®, or a hook and loop. Further, the carriers may be attached to the helmet shell by tabs that are bolted or otherwise attached at a mounting point, such as, for example, with a bolt that goes through the helmet shell to attach a chinstrap as well as the impact liner system to the helmet shell.

As illustrated in FIGS. 1-3B, the openings in the carriers 114 and 116 are circular in shape and the energy management structures 112 comprise cylindrical outer walls sized and configured to be received in the openings. However, it should be understood that the carriers of the present application may comprise openings of various shapes and sizes to accommodate a variety of energy management structures, including any one or more of the energy management structures described herein. Further, the carriers of the present application may be configured to position energy management structures of various shapes and sizes at variety of locations and in a variety of concentrations within the helmet shell. In certain embodiments, the carriers of the impact liner system may also comprise a plurality of openings or slots that permit air to circulate between the head of the user and the helmet shell to facilitate cooling of the user's head.

As illustrated in FIGS. 1 and 1A, the energy management structures 112 are positioned in the carriers 114 and 116 such that the top of the energy management structure is facing the head of the user and the base or bottom or the energy management structure is facing the backface of the helmet shell 110. However, in other embodiments, one or more of the energy management structures 112 may be positioned such that the top of the structure is facing the backface of the helmet shell 110 and the base or bottom is facing the user's head.

Further, the energy management structures of the present application may be removably secured in the openings of the carriers in a variety of ways, such as, for example, with a friction or interference fit, one or more fasteners, adhesive, clips, pins, snaps, tape, buckles, Velcro®, or a hook and loop. For example, as illustrated in FIGS. 2A and 3A, the energy management structures 112 comprise one or more resilient protrusions 222 extending outward from the outer wall of the structure. When the energy management structures 112 are inserted into the carrier openings, the edge of the opening slides over the one or more protrusions 222 and is positioned between the protrusions and a flange of the energy management structure. As such, the energy management structures 112 snap into the openings of the carrier 114 and 116 and are removably secured in the opening.

In some embodiments, the energy management structures of the present application may be integrally formed with the carriers. For example, the energy management structures may be integrally molded with the carriers such that the carrier forms a common base for the structures. Further, the energy management structures and the carriers may be RF welded together. For example, a flange of the energy management structure may be welded to the radial portion around an opening in the carrier to secure the energy management structure within the opening. In some embodiments, the carriers do not have openings and the energy management structures are attached directly to the carrier. The energy management structures may be attached to the carriers in a variety of ways, such as, for example, with one or more fasteners, adhesive, weld, clips, pins, snaps, tape, buckles, Velcro®, or a hook and loop.

Each carrier of the present application is generally formed from a single piece of material. However, any one or more carriers may comprise a plurality of components integrally formed or otherwise secured together. Further, the carriers may be formed from a variety of materials capable of supporting the energy management structures of the present application, such as, for example, thermoplastic polymers including polyurethanes (TPU), polyethylene, polycarbonate, and Acrylonitrile butadiene styrene (ABS). In certain embodiments, the carriers are made from thermoplastic polyurethane BASF Elastollan 1164D53. Further, the carriers of the present application are generally between about 0.025 inch and about 0.100 inch thick. In certain embodiments, the carriers are about 0.040 inch thick.

The energy management structures of the present application may be a variety of shapes and configurations. For example, the energy management structures may comprise one or more walls that are configured to bend, buckle, crush, or otherwise deform upon impact to absorb and/or dissipate the impact energy from the force of the impact. The one or more walls of the energy management structure may take a variety of different forms. For example, the walls may form a cylinder, truncated cone, or hemisphere and may comprise one or more cross sections shaped as a circle, rectangle, square, trapezoid, hexagon, diamond, helix, or other shape. The walls of the energy management structures may also be bowed or curved. In addition, inserts or other structures, such as foam inserts or various polymer structures, may be placed within the energy management structure and may or may not be attached to the energy management structure or carrier.

FIGS. 4A-10B illustrate various exemplary embodiments of energy management structures of the present application. The energy management structures are generally removably attached to a carrier of the impact liner system and positioned between the backface of the helmet shell and the user's head. The energy management structures are configured such that they compress during an impact event to absorb and/or dissipate the impact energy from the force of the impact.

The energy management structures illustrated in FIGS. 4A-10B generally comprise an outer vertical wall and an inner structure having a vertical wall. Upon impact, the energy management structure compresses and the outer vertical wall will bend, buckle, crush, or otherwise deform to absorb and/or dissipate the impact energy from the force of the impact. Further, once the energy management structure is compressed to a certain point, the vertical wall of the inner structure will also bend, buckle, crush, or otherwise deform to further absorb and/or dissipate the impact energy.

During an impact event, the vertical wall of the inner structure will act as "stop" once the outer vertical wall is compressed to a certain point and the bottom of the vertical wall contacts the helmet shell. In this regard, the vertical wall of the inner structure will prohibit further stress on the outer vertical wall, thereby prohibiting excessive plastic (i.e., permanent) deformation and improving performance for multiple high compression impacts. Further, during an impact event, the vertical wall of the inner structure will work in concert with the outer vertical wall to produce an overall compressive response profile of the energy management structure. The compressive response profile of the outer vertical wall will be added to the compressive response profile of the vertical wall of the inner structure to produce the overall compressive response profile of the energy management structure.

The energy management structures illustrated in FIGS. 4A-7D comprise a base portion 450 having a bottom wall 452 and a cylindrical vertical wall 454 extending from the bottom wall and about a vertical axis of the structure. Furthermore, the base portion 450 comprises a radial flange 456 extending outward from the vertical wall 454 and about the vertical axis. As shown, the bottom wall 452 of the base portion 450 comprises a central opening 458 substantially aligned with the vertical axis and a plurality of slotted openings 460 spaced radially about the vertical axis.

As illustrated in FIGS. 4A-7D, the base portion 450 also comprises one or more protrusions 462 extending outward from the cylindrical vertical wall 454 to facilitate placement and attachment of the structure within an opening in a carrier 114 and 116 of the impact liner system 100. When the energy management structure is inserted into the carrier opening, the edge of the opening slides over the one or more protrusions 462 and is positioned between the protrusions and the flange 456 of the base portion 450. As such, the energy management structure snaps into the opening of the carrier 114 and 116 and is removably secured in the opening.

The base portion 450 may take a variety of different forms. For example, in certain embodiments, the vertical wall of the base portion may form a truncated cone or hemisphere and may comprise one or more cross sections shaped as a circle, rectangle, square, trapezoid, hexagon, diamond, helix, or other shape. The vertical wall of the base portion may also be bowed or curved in certain embodiments. Further, the bottom wall of the base portion may have more or less openings of various shapes and sizes located anywhere on the bottom wall. In certain embodiments, the openings in the bottom wall are spaced around an attachment feature (e.g., a piece of Velcro®) on the bottom wall that may be used to removably attach the energy management structure to the helmet shell. As such, the attachment feature does not prohibit airflow through the energy management structure. In certain embodiments, the bottom wall does not have any openings.

The energy management structures illustrated in FIGS. 4A-7D also comprise a top portion or cap that is attached to the base portion 450. Each top portion comprises top wall and an inner structure. The inner structure has a vertical wall that extends from the top wall and about the vertical axis of the energy management structure. When the top portion is attached to the bottom portion 450, the inner structure is inserted into the base portion such that the vertical wall 454 of the base portion surrounds the vertical wall of the top portion.

The energy management structures illustrated in FIGS. 4A-7D have an inner structure with an open bottom. However, in certain embodiments, the inner structure may comprise a bottom wall and may or may not include one or more openings in the bottom wall and/or the vertical wall. Further, as shown, the top wall comprises a central opening substantially aligned with the vertical axis and a plurality of openings spaced radially about the vertical axis. However, the top portion may have more or less openings of various shapes and sizes located anywhere on the top wall. In certain embodiments, the top wall does not have any openings.

FIGS. 4A-4D illustrate an exemplary energy management structure 400 comprising a top portion 404 having an inner structure with a vertical wall 410 shaped as a truncated cone. The vertical wall 410 extends from a top wall 406 of the top portion 404 and about a vertical axis 402 of the energy management structure 400. The angle $A_1$ of the vertical wall 410 with respect to the vertical axis 402 is generally between about 0 and about 60 degrees. In certain embodiments, the angle $A_1$ is about 20 degrees.

FIGS. 5A-5D illustrate an exemplary energy management structure 500 comprising a top portion 504 having an inner structure with a vertical wall 510 shaped as a truncated cone. The vertical wall 510 extends from a top wall 506 of the top portion 504 and about a vertical axis 502 of the energy management structure 500. As shown, the vertical wall 510 extends a greater distance from the top wall 506 than the vertical wall 410 extends from the top wall 406. The angle $A_2$ of the vertical wall 510 with respect to the vertical axis 502 is generally between about 0 and about 60 degrees. In certain embodiments, the angle $A_2$ is about 20 degrees.

The energy management structures 400 and 500 provide an improved off-axis impact response (i.e., non-perfect vertical compression). This occurs because the conical shape of the inner structure provides the ability to deform with more wall buckling than wall bending when compressed off-axis. This wall buckling results in a stiffer response or higher resistance to compression than bending, which allows mitigation of higher energy impacts. While a cylindrical wall provides a more optimal buckling mode than a conical wall in a pure axial compression, the cylindrical wall is put into a bending rather than buckling mode when compressed off-axis. This bending mode typically provides much less resistance to compression, i.e. the structure collapses rather than mitigating the impact. The buckling mode of a conical wall prohibits this collapsing effect for a greater range of impact angles (off-axis) than a cylindrical wall; and further, the outer structure aids in stabilizing the inner structure and maintaining the preferable higher-stiffness buckling mode.

Figure 4A:
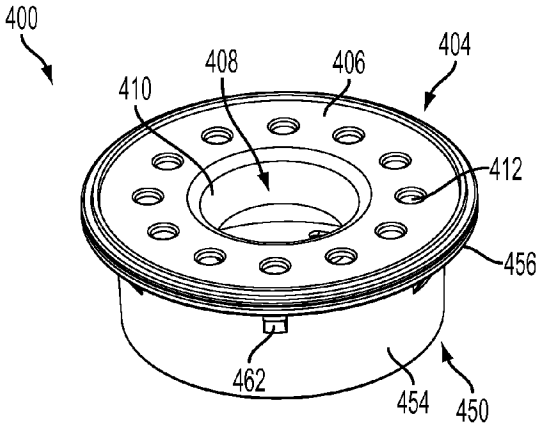
FIGS. 4A and 4B are perspective and cross sectional views of an energy management structure according to an embodiment of the present application.
Figure 5A:
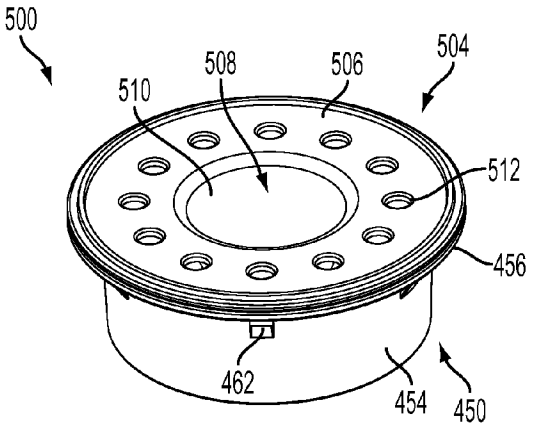
FIGS. 5A and 5B are perspective and cross sectional views of an energy management structure according to an embodiment of the present application.

As illustrated in FIGS. 4A and 5A, the top portions 404 and 504 of the energy management structures 400 and 500 comprise a central opening 408 and 508 substantially aligned with the vertical axis 402 and 502 and a plurality of smaller openings 412 and 512 spaced radially about the vertical axis. The openings permit air to escape from within the structure during impact. The openings are sized and configured such that the exiting of the air during impact does not affect the compressive behavior of the structure. Further, the openings permit air to circulate through the energy management structure to facilitate cooling of the user's head.

The top portion of the energy management structures may have any number of openings of various shapes and sizes located at various locations on the top wall. For example, FIGS. 7A-7D illustrate an exemplary energy management structure 700 that is similar to the energy management structure 400. However, a top portion 704 of the energy management structure 700 comprises a plurality of slotted openings 712 of various sizes spaced radially about a vertical axis 702 of the structure and at various distances from the vertical axis. The energy management structure 400 comprises circular openings 412 spaced radially about the vertical axis 402 at substantially the same distance. In certain embodiments, the openings in the top wall of the energy management structure are spaced around an attachment feature (e.g., a piece of Velcro®) on the top wall that may be used to removably attach a pad or other item to the energy management structure. As such, the attachment feature does not prohibit airflow through the energy management structure. Furthermore, in certain embodiments, the top wall may not have any openings.

Figure 4B:
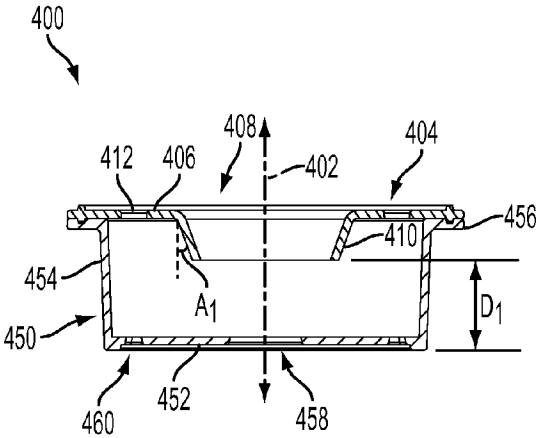
Figure 4C:
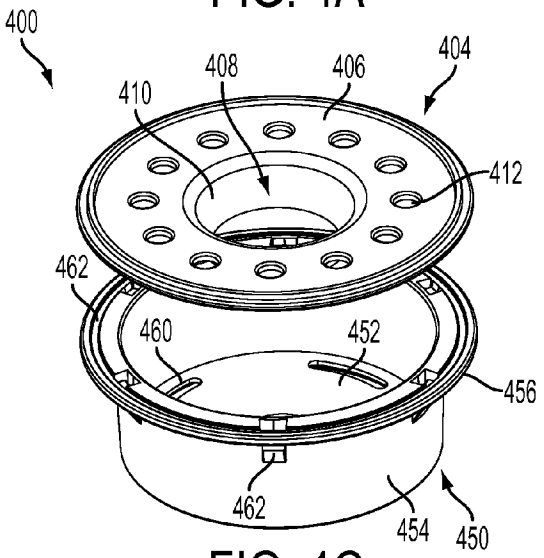
FIGS. 4C and 4D are exploded perspective and cross sectional views of the energy management structure of FIGS. 4A and 4B, wherein a top portion of the energy management structure is removed from a bottom portion.
Figure 4D:
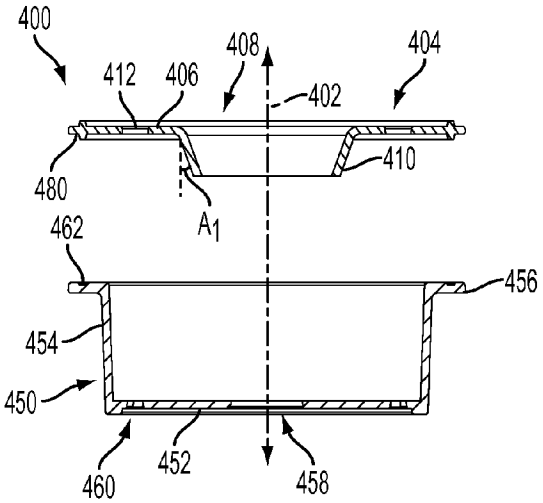
Figure 5B:
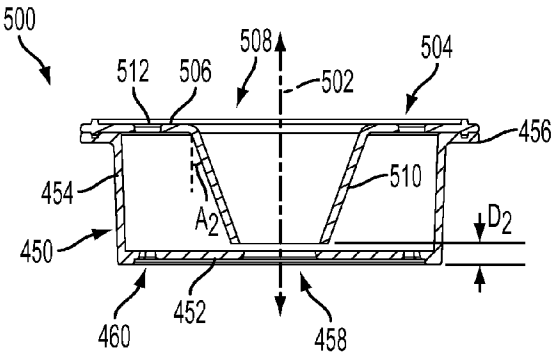
Figure 5C:
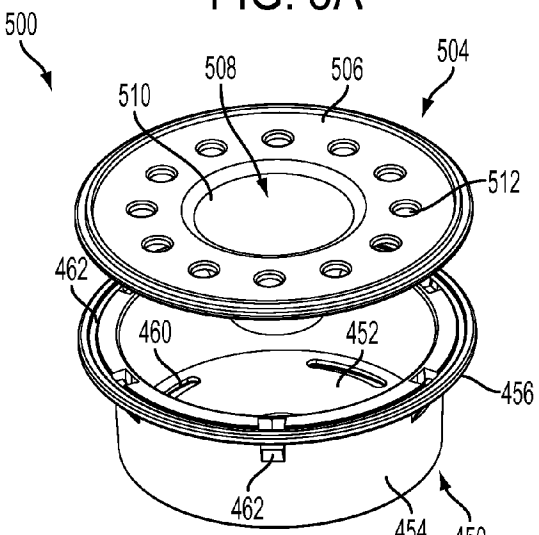
FIGS. 5C and 5D are exploded perspective and cross sectional views of the energy management structure of FIGS. 5A and 5B, wherein a top portion of the energy management structure is removed from a bottom portion.
Figure 5D:
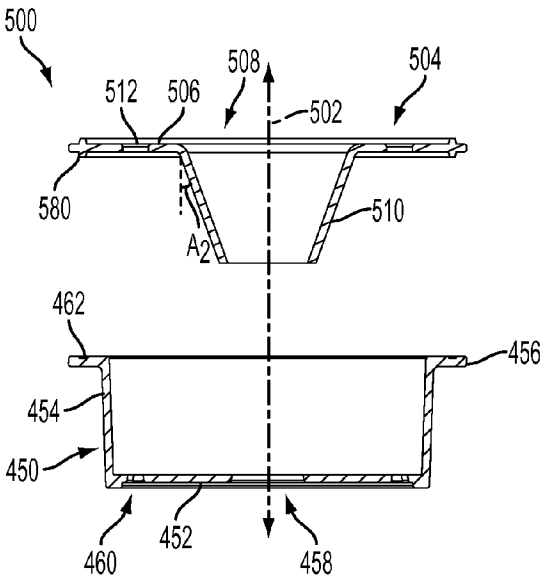
Figure 6A:
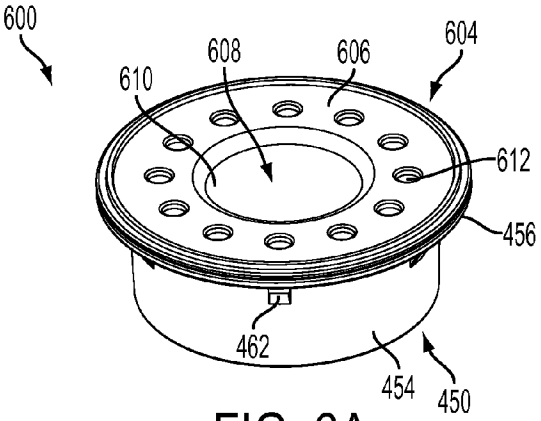
FIGS. 6A and 6B are perspective and cross sectional views of an energy management structure according to an embodiment of the present application.
Figure 6B:
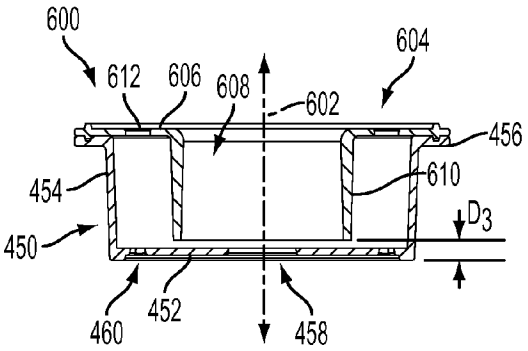
Figure 6C:
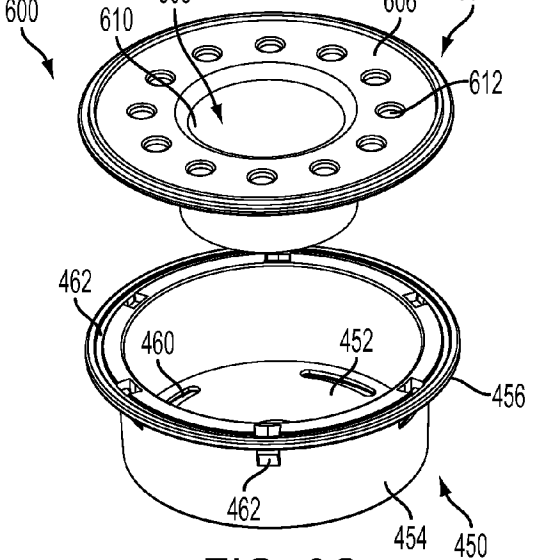
FIGS. 6C and 6D are exploded perspective and cross sectional views of the energy management structure of FIGS. 6A and 6B, wherein a top portion of the energy management structure is removed from a bottom portion.
Figure 6D:
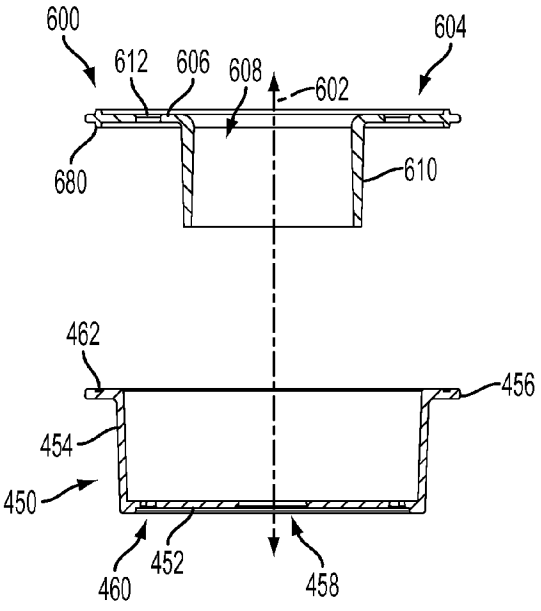
Figure 7B:
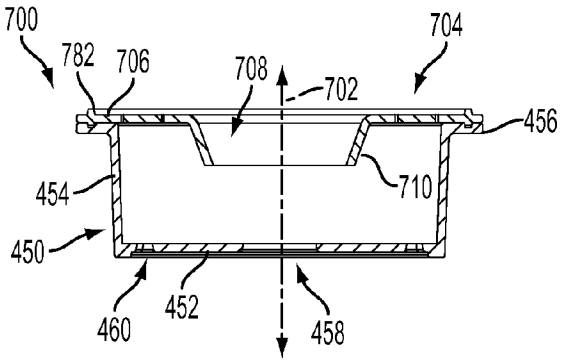
FIGS. 7A and 7B are perspective and cross sectional views of an energy management structure according to an embodiment of the present application.
Figure 7D:
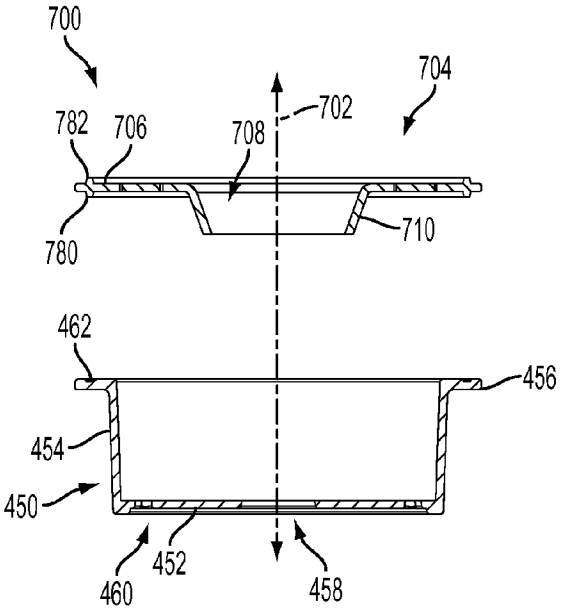
FIGS. 7C and 7D are exploded perspective and cross sectional views of the energy management structure of FIGS. 7A and 7B, wherein atop portion of the energy management structure is removed from a bottom portion.
Figure 7A:
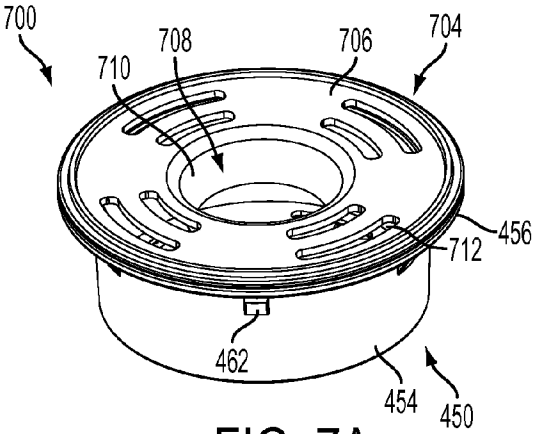
Figure 7C:
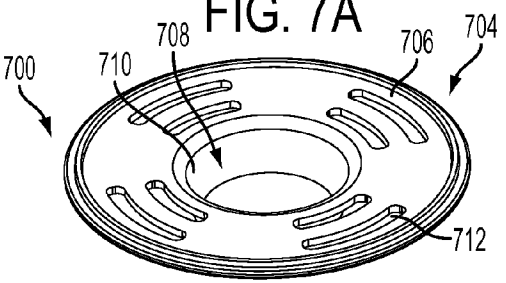
Figure 7C:
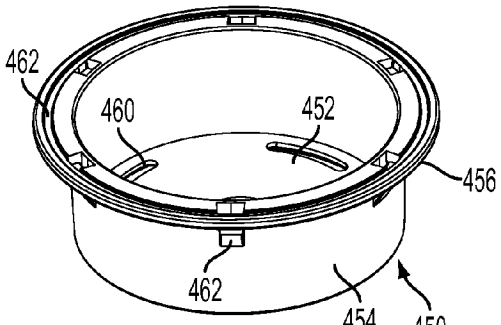

As illustrated in FIGS. 4B and 5B, the distance $D_1$ between the bottom of the vertical wall 410 and the bottom of the vertical wall 454 of the base portion 450 is generally between about 0 and about 0.75 inch and the distance $D_2$ between the bottom of the vertical wall 510 and the bottom of the vertical wall 454 of the base portion 450 is generally between about 0 and about 0.25 inch. In certain embodiments, the distance $D_1$ is about 0.35 inch and the distance $D_2$ is about 0.050 inch. However, the distance between the bottom of the inner structure vertical wall and the bottom of the outer vertical wall may be more or less in other embodiments depending on the particular application of the impact liner system. For example, in certain embodiments, the bottom of the inner structure vertical wall may extend below the bottom of the outer vertical wall.

FIGS. 6A-6D illustrate an exemplary energy management structure 600 comprising a top portion 604 having an inner structure with a cylindrical vertical wall 610. The vertical wall 610 extends from a top wall 606 of the top portion 604 and about a vertical axis 602 of the energy management structure 600. The distance $D_3$ between the bottom of the vertical wall 610 and the bottom of the vertical wall 454 of the base portion 450 is generally between about 0 and about 0.75 inch. In certain embodiments, the distance $D_3$ is about 0.050 inch. Similar to the energy management structures 400 and 500, the top wall 606 comprises a central opening 608 substantially aligned with the vertical axis 602 and a plurality of smaller openings 612 spaced radially about the vertical axis. The openings permit air to escape from within the structure during impact. The openings are sized and configured such that the exiting of the air during impact does not affect the compressive behavior of the structure. Further, the openings permit air to circulate through the energy management structure to facilitate cooling of the user's head.

An inner structure with a cylindrical vertical wall provides several advantages. A cylindrical geometry provides a higher crush strength than conical geometry; however, a cylindrical inner structure may be more prone to collapsing off-axis if the compression forces are not aligned perpendicular to the center axis of the inner structure. The relatively small aspect ratio of diameter-to-height may make the inner cylinder prone to collapsing onto its' side, but the outer structure provides stability to ensure a high stiffness buckling mode occurs during compression. Additionally, the use of the inner cylindrical structure allows for the use of two types of material, one for the outer wall and one for the inner wall, to achieve a unique overall compressive response. This can be used to balance properties such as temperature operating range, or compressive strength versus multi-compression durability.

The top portion of the energy management structures may be attached to the base portion in a variety of ways and may or may not be removable from the base portion. For example, the top portion may be attached to the base portion with a friction or interference fit, fastener, clip, pin, projection, snap, buckle, adhesive, tape, Velcro®, hook and loop, pin and slot, or the like. The top portion may also be integrally formed with the base portion or separately formed and RF welded to the base portion. As illustrated in FIGS. 4A-7D, the radial flange 456 of the base portion 450 comprises a channel 462 sized and configured to mate with a corresponding projection on the top portion (see, e.g., projections 480, 580, 680, and 780). The projection mates with the channel 462 to align the top portion relative to the base portion 450. Further, the channel 462 and projection may be used to facilitate welding of the top portion to the base portion 450. The channel 462 and projection may also be sized and configured to form a friction or interference fit to removably couple the top portion to the base portion 450.

Figure 8B:
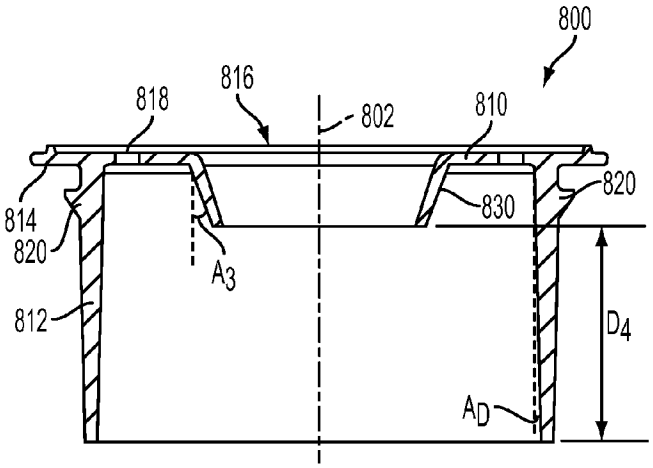
FIGS. 8A and 8B are perspective and cross sectional views of an energy management structure according to an embodiment of the present application.
Figure 8A:
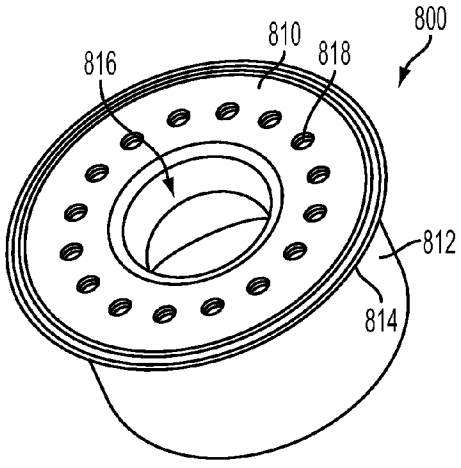

FIGS. 8A and 8B illustrate an exemplary energy management structure 800 according to an embodiment of the present application. The energy management structure 800 comprises a top wall 810 and a cylindrical vertical wall 812 extending from the top wall and about a vertical axis 802 of the structure. Furthermore, the energy management structure 800 comprises a radial flange 814 extending outward from the vertical wall 812 and about the vertical axis 802. The top wall 810 comprises a central opening 816 aligned with the vertical axis 802 and a plurality of openings 818 spaced radially about the vertical axis.

The energy management structure 800 also comprises one or more protrusions 820 extending outward from the cylindrical vertical wall 812 to facilitate placement and attachment of the structure within an opening in a carrier of the impact liner system. When the energy management structure 800 is inserted into the carrier opening, the edge of the opening slides over the one or more protrusions 820 and is positioned between the protrusions and the flange 814 of the energy management structure. As such, the energy management structure 800 snaps into the opening of the carrier and is removably secured in the opening.

Figure 9B:
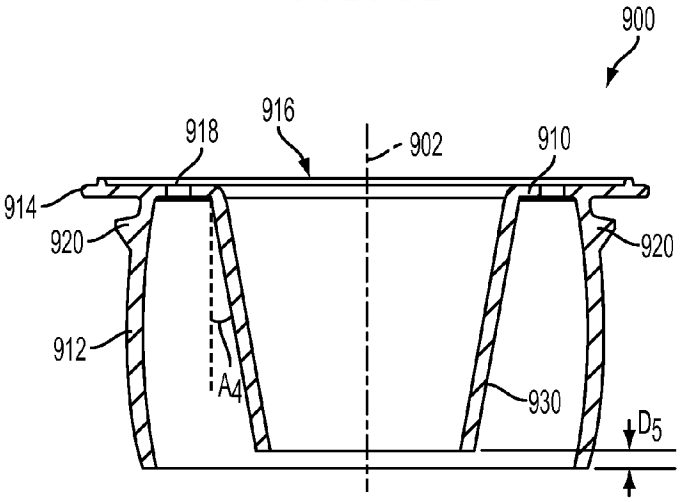
FIGS. 9A and 9B are perspective and cross sectional views of an energy management structure according to an embodiment of the present application.
Figure 9A:
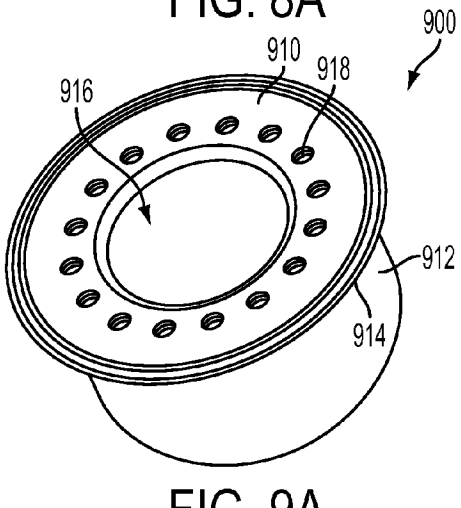

FIGS. 9A and 9B illustrate an energy management structure 900 according to an embodiment of the present application. The energy management structure 900 comprises a top wall 910 and a bowed or curved cylindrical vertical wall 912 extending from the top wall and about a vertical axis 902 of the structure. Furthermore, the energy management structure 900 comprises a radial flange 914 extending outward from the vertical wall 912 and about the vertical axis 902. The top wall 910 comprises a central opening 916 aligned with the vertical axis 902 and a plurality of openings 918 spaced radially about the vertical axis. The energy management structure 900 also comprises one or more protrusions 920 extending outward from the vertical wall 912.

As illustrated in FIGS. 8A-9B, each energy management structure 800 and 900 comprises an inner structure having a vertical wall 830 and 930 shaped as a truncated cone and extending from the top wall 810 and 910 and about the vertical axis 802 and 902 of the structure. The angle $A_3$ of the vertical wall 830 is between about 0 and about 60 degrees with respect to the vertical axis 802 and the angle $A_4$ of the vertical wall 930 is between about 0 and about 30 degrees with respect to the vertical axis 902. In one embodiment, the angle $A_3$ is about 30 degrees and the angle $A_4$ is about 20 degrees.

As illustrated in FIGS. 8B and 9B, the distance $D_4$ between the bottom of the vertical wall 830 and the bottom of the vertical wall 812 is between about 0 and about 0.75 inches and the distance $D_5$ between the bottom of the vertical wall 930 and the bottom of the vertical wall 912 is between about 0 and about 0.75 inches. In one embodiment, the distance $D_4$ is about 0.5 inches and the distance $D_5$ is about 0.050 inches. However, the distance between the bottom of the inner structure and the bottom of the outer vertical wall may be more or less in other embodiments depending on the particular application of the impact liner system.

Figure 10B:
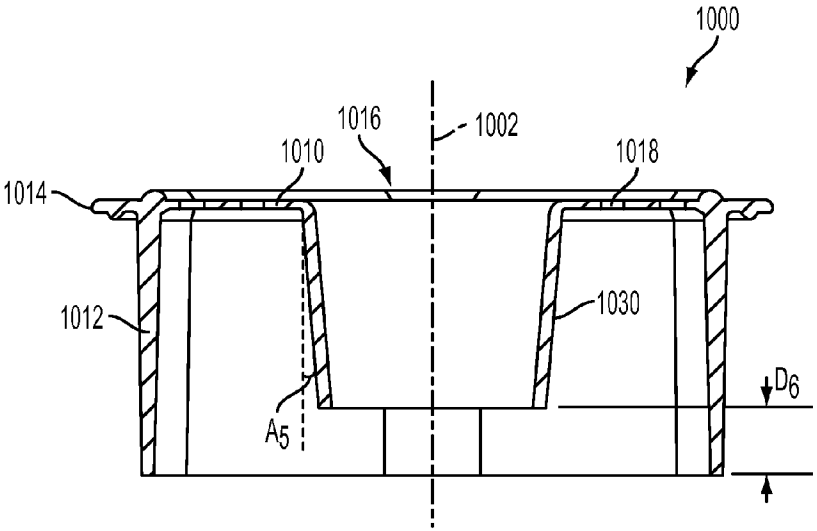
FIGS. 10A and 10B are perspective and cross sectional views of an energy management structure according to an embodiment of the present application.
Figure 10A:
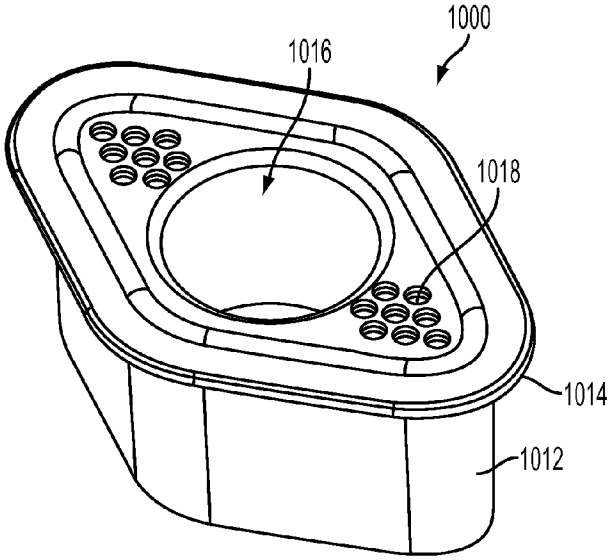

FIGS. 10A and 10B illustrate an energy management structure 1000 according to an embodiment of the present application. As shown, the energy management structure 1000 comprises a top wall 1010 and a diamond shaped vertical wall 1012 extending from the top wall. A flange 1014 extends outward from the vertical wall 1012 at a top end of the structure. The top wall 1010 comprises a central opening 1016 aligned with a vertical axis 1002 of the energy management structure 1000. The top wall 1010 also comprises a plurality of smaller openings 1018 configured to permit air to escape from within the structure 1000 during impact. Further, the openings 1016 and 1018 may permit air to circulate through the energy management structure 1000 to facilitate cooling of the user's head.

As illustrated in FIGS. 10A and 10B, the energy management structure 1000 also comprises an inner structure having a vertical wall 1030 shaped as a truncated cone and extending from the top wall 1010 and about the vertical axis 1002 of the structure. The angle $A_5$ of the vertical wall 1030 with respect to the vertical axis 1002 is between about 0 and about 60 degrees. In one embodiment, the angle $A_5$ is about 5 degrees. Further, the distance $D_6$ between the bottom of the vertical wall 1030 and the bottom of the vertical wall 1012 is between about 0 and about 0.7 inches. In one embodiment, the distance $D_6$ is about 0.25 inches. However, the distance between the bottom of the inner structure and the bottom of the outer vertical wall may be more or less in other embodiments depending on the particular application of the impact liner system.

Upon impact, the energy management structure 1000 compresses and the diamond shaped vertical wall 1012 will bend, buckle, crush, or otherwise deform to absorb and/or dissipate the impact energy from the force of the impact. Further, once the energy management structure 1000 is compressed to a certain point, the vertical wall 1030 of the inner structure will bend, buckle, crush, or otherwise deform to further absorb and/or dissipate the impact energy. As such, the compression of the energy management structure 1000 provides a first and second stiffness response that permits the head of the user to gently accelerate to a stop after impact.

Figure 12:
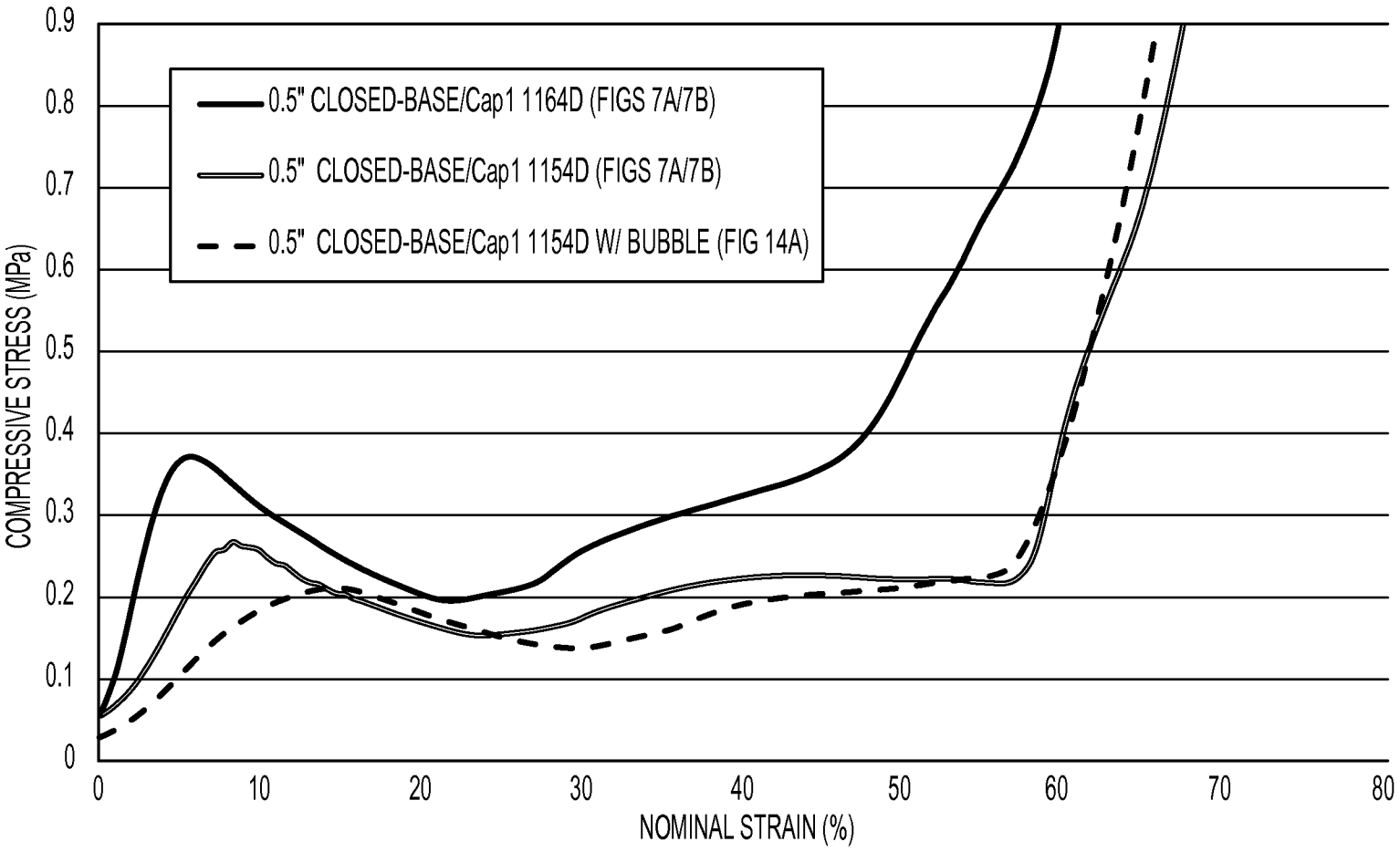
FIG. 12 illustrates compression curves for the energy management structures shown in FIGS. 7A, 7B, and 14A.
Figure 13:
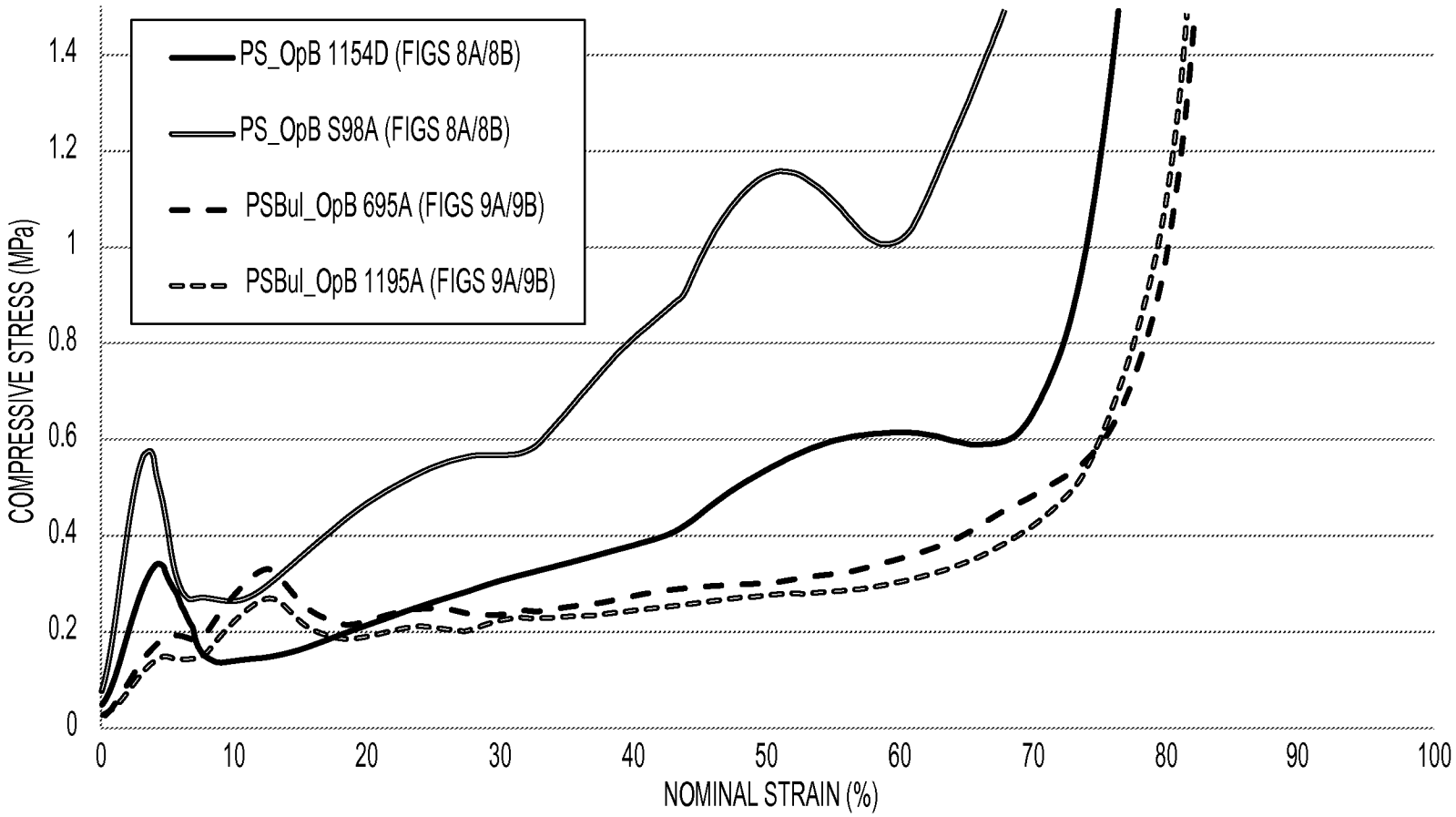
FIG. 13 illustrates compression curves for the energy management structures shown in FIGS. 8A, 8B, 9A, and 9B.
Figure 14A:
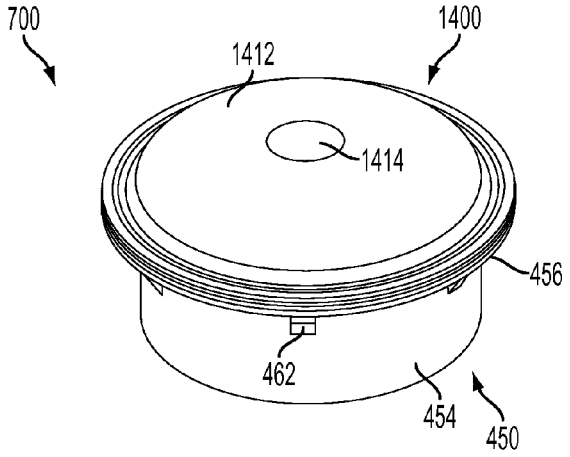
FIG. 14A is a perspective view of an energy management structure according to an embodiment of the present application.

Certain energy management structures of the present application were compressed and the aggregate stiffness or compression curves corresponding to the compression of the energy management structures are shown in FIGS. 12 and 13. Specifically, FIG. 12 illustrates the compression of the closed base energy management structure 700 illustrated in FIGS. 7A and 7B. The energy management structure 700 having an outer diameter of about ½ inch was tested constructed of two different materials, BASF Elastollan 1164D and BASF Elastollan 1154D. The 1164D material has a 64 shore D durometer and is harder than 1154D which has a 54 shore D durometer. Further, the energy management structure 700 constructed of BASF Elastollan 1154D was tested with the pad structure 1400 attached to the top portion 704 (FIG. 14A). FIG. 13 illustrates the compression of the open base energy management structure 800 illustrated in FIGS. 8A and 8B and the open base energy management structure 900 illustrated in FIGS. 9A and 9B. The energy management structure 800 was tested constructed of two different materials, BASF Elastollan 1154D and BASF Elastollan S98A. The S98A material has a 98 shore A durometer and provides a stiffer response than the 1154D material. The energy management structure 900 was tested constructed of two different materials, BASF Elastollan 695A and BASF Elastollan 1195A, both are a 95 shore A hardness and exhibit similar compression profiles.

As illustrated in FIGS. 12 and 13, the stiffness or compression curves are changed by varying the material for the energy management structures. For example, as shown in FIG. 12, the energy management structure 700 constructed of the 1164D material provided a greater stiffness response than the structure constructed of the 1154D material. However, the structure 700 constructed of the 1164D material reached a point of plastic deformation at a lesser compressive strain than the structure constructed of the 1154D material. Similarly, as shown in FIG. 13, the energy management structure 800 constructed of the S98A material provided a greater stiffness response than the structure constructed of the 1154D material. However, the structure 800 constructed of the S98A material reached a point of plastic deformation at a lesser compressive strain than the structure constructed of the 1154D material. The ideal response of a structure depends on the specific application, for example in a helmet it must behave appropriately for the expected impact energy levels, multiple impact requirements, temperature operating range and other factors. It should be noted that the energy management structures can be made from different materials or similar materials in order to provide a more ideal curve for the actual loading application.

As illustrated in FIG. 12, the energy management structure 700 with the pad structure 1400 attached to the top portion 704 provided a softer initial crush response than the structure without the pad structure. In other words, the pad structure 1400 permits the energy management structure 700 to have an initial "give" or pliability. This initial "give" provides a comfort response to the overall performance of the energy management structure 700.

As illustrated in FIG. 13, the bowed or curved vertical wall 912 of the energy management structure 900 provides a softer initial crush response than that of the vertical wall 812 of the energy management structure 800. In other words, the bowed or curved vertical wall 912 permits the energy management structure 900 to have an initial "give" or pliability. This initial "give" provides a comfort response to the overall performance of the energy management structure 900. Along with this generally softer response, the bowed vertical wall 912 of the energy management structure 900 may be crushed further than the vertical wall 812 of the energy management structure 800 while still maintaining a nearly perfect elastic response (i.e., a full rebound or very minimal permanent deformation), thereby improving performance for multiple high compression impacts. The vertical wall 812 of the energy management structure 800 provides a greater stiffness response than the bowed vertical wall 912 of the energy management structure 900. This greater stiffness response is due to a more aggressive bending-deformation mode than the bowed vertical wall 912. However, in some embodiments, the vertical wall 812 of the energy management structure 800 may reach a point of plastic deformation at lesser compressive strains than the bowed vertical wall 912.

The outer vertical wall of the energy management structures of the present application generally have an outside diameter between about 0.5 inch and about 2.5 inches. In certain embodiments, the outside diameter of the outer cylindrical vertical wall of the energy management structure is about 1.2 inches. Further, the outer vertical wall of the energy management structures generally have a height between about 0.3 inch and about 1.75 inches. In certain embodiments, the height of the outer cylindrical vertical wall of the energy management structure is about 0.75 inch.

Any one or more vertical wall of the energy management structures may have a draft. The draft angle of the vertical wall may range between 0 degrees (i.e., no draft) and about 10 degrees. For example, FIG. 8B illustrates a draft angle $A_D$ of the vertical wall 812 with respect to the vertical axis 802 of the energy management structure 800. In one embodiment, the draft angle $A_D$ of the vertical wall 812 is about 3.0 degrees, i.e., each side of the wall is drafted 1.5 degrees from vertical.

The vertical wall thickness of the energy management structures may be selected to vary the stiffness of the structure. Further, the thickness of the vertical walls may be selected to vary the range of travel when the structure buckles upon impact, thus varying the bottom out strain of the structure. For example, the vertical wall thickness of the energy management structures of the present application may be between about 0.020 inch and about 0.125 inch to provide a desired stiffness of the structure. In one embodiment, the energy management structures have an average vertical wall thickness of about 0.0485 inch. For example, in one exemplary embodiment in which the vertical wall has a draft angle of about 3 degrees, the thickness at the base or bottom of the vertical wall is about 0.030 inch and the thickness at the top of the vertical wall is about 0.067. This vertical wall thickness provides a desired stiffness of the structure while maximizing the bottom out strain of the structure. Further, the top and/or bottom wall thickness of the energy management structures of the present application may be between about 0.020 and about 0.125 inch. In certain embodiments, the energy management structures have a consistent vertical wall thickness that is drafted evenly, e.g., 1.5 degrees in the same direction on each side of the wall, giving a top vertical wall thickness of about 0.030 inch and a bottom vertical wall thickness of about 0.030 inch, which is the case for the closed base structures shown in FIGS. 4B, 4D, 5B, 5D, 6B, 6D, 7B and 7D, and the wall thickness of the flange is about 0.035 inch.

The energy management structures of the present application may comprise a variety of materials. For example, the material of the energy management structures may range from soft elastomers to stiff thermoplastics and thermosets or even metals. In one embodiment, the energy management structures are made from a thermoplastic polyurethane (TPU). More specifically, the energy management structures are made from a grade of BASF Elastollan including 1154D53, 1164D53, 1174D53, or other grades of Elastollan using either polyether or polyester base polyols, additionally other TPUs may be used such as Bayer Texin, DuPont Bexloy, or Merquinsa Pearlthane. However, the energy management structures may be made from a variety of other thermoplastic elastomers (TPE), such as olefin based TPE's like Santoprene or Arnitel, thermoplastic copolyesters (COPE) such as RTP 1500, polyether block amide elastomers such as Pebax, silicon based chemistries, or engineering resins such as PEEK or Ultem. Further, in some embodiments, thermoset elastomers may be used. Other materials that may be used include Dupont Hytrel, Dupont ETPV, or impact modified 6/6 nylon. Structures made with different materials or different grades of the same material may be used together in the same liner; this can aid in tuning the liner for optimal performance across multiple impact locations.

The material used for the energy management structures may be selected based on a variety of characteristics. For example, the material may be selected based on its response to varying temperatures. A material may be selected based on its performance across a range of temperatures and the environment in which the impact liner system will likely be used. In some embodiments, the material of the energy management structures may be selected to counteract the negative changes of other helmet components, such as the stiffening of a helmet shell in colder conditions.

The material of the energy management structures may also be selected based on its strain rate sensitivity. For example, a highly strain rate sensitive material may permit varying degrees of rate stiffening in the energy management structures during the varying deformation modes. Such a material may be used to provide an energy management structure that acts stiffer in an impact event and softer when the collision is not at impact rates or in lower velocity hits. This may be advantageous when compared to other helmet materials which may stiffen 2 to 3 times at impact rates when compared to nearly static loading, but do not show appreciable stiffening when loaded at two rates that are not greatly disparate.

The material of the energy management structures may also be selected based on the particular application or performance requirements. For example, military helmet (ACH) performance testing requires the impact liner to perform ideally at 17 ft/sec, 14 ft/sec, and 10 ft/sec impact velocities. Although not dramatic changes in velocity, given the mass of the head form there is a 2 to 3 times increase in kinetic energy. As such, a material of the energy management structures may be selected that stiffens at 2 to 3 times across that range of velocities.

The energy management structures are generally injected molded from a single piece of material. However, in some embodiments, the energy management structures may be made from a plurality of components. The multiple components may be injection molded and may be RF welded together. Other methods for fabricating and assembling the energy management structures may also be used, such as, for example, ultrasonic, heat staking, co-molding, insert molding, thermoforming, or rotomolding. Void spaces within the structure may also be filled with foam or other padding or elastomeric material to alter the compression response of the structure, generally by adding stiffness to the structure. The filler material may be pre-fabricated to shape and press-fit or adhered in place. The filler material may also be poured or formed in place within each structure.

Furthermore, the stiffness of the energy management structures of the present application is not dependent on packing density or a combination of packing density and chemistry. Thus, the overall stiffness response of the impact liner system may be increased without dramatically increasing the weight of the helmet. This provides an advantage over energy absorbing materials, such as foam, in which the density of the material may have to dramatically increase depending on the application and required stiffness, thus increasing the weight of the helmet. In many applications, such as performance applications, it is advantageous to modify stiffness without appreciably increasing weight.

Various pads may be used with the impact liner system of the present application. The pads are generally positioned between the energy management structure and the user's head for the purpose of comfort to the wearer. However, they may also be placed between the structure and the outer shell, or between structures, and serve to alter or improve helmet performance in certain locations. The pads may be configured to deform or crush upon impact and consume a portion of the impact energy. The pads generally provide a substantially softer initial crush response than that of the energy management structure while still maintaining a nearly perfect elastic response (i.e., a full rebound or very minimal permanent deformation, depending on materials utilized). Furthermore, the pads may be configured to comfort various portions of the user's head and may be used to adjust the sizing and fit of the helmet on the user's head.

Pads of various shapes and sizes may be used. Further, the pads may be positioned and/or configured in a variety of ways to comfort various portions of the user's head. The pads may also comprise a variety of materials, such as foam (e.g., polyurethane foam, polyethylene foam, etc.), expanded polypropylene, expanded polystyrene, vinyl nitrile, or molded polymer structures such as thermoplastic urethane (TPU). The pads may be water resistant or moisture absorbent. Further, any one or more of the pads may comprise a different type of material than another pad. The pads may also be encased in a fabric and/or film material.

Figure 14B:
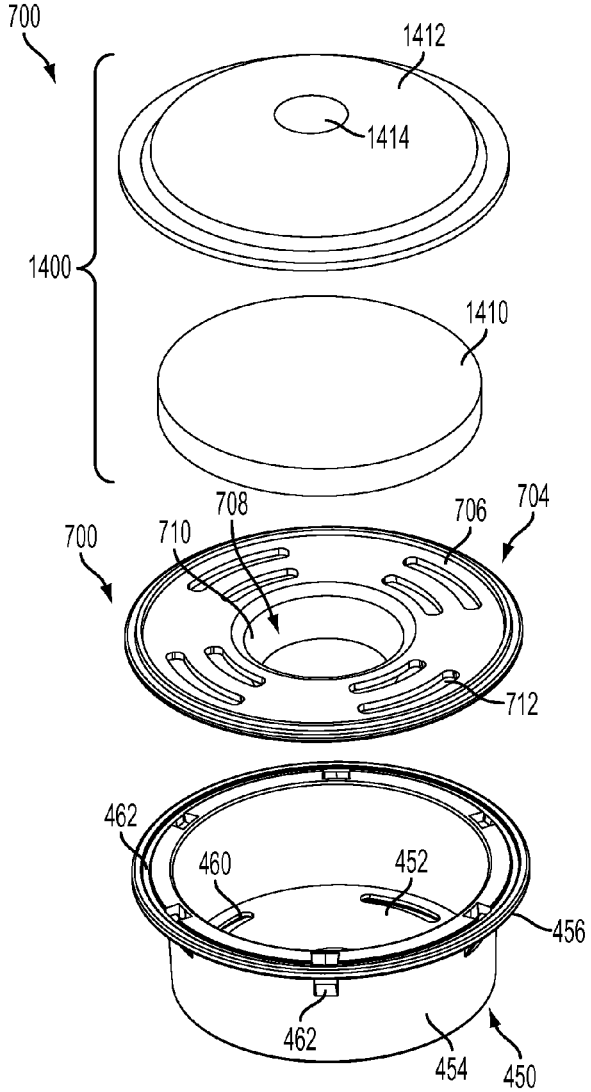
FIG. 14B is an exploded perspective view of the energy management structure of FIG. 14A.

FIGS. 14A and 14B illustrate a pad structure 1400 attached to the top portion 704 of the energy management structure 700 illustrated in FIGS. 7A-7D. As shown, the pad structure 1400 is circular in shape and is substantially the same diameter as the top wall 706. The pad structure 1400 comprises a resilient foam 1410 encased in a collapsible, hemispherical polymer structure 1412. Further, the polymer structure 1412 comprises a central opening 1414 that permits air to escape from within the energy management structure 700 and through the porous foam 1410 during impact. Further, the opening 1414 permits air to circulate through the energy management structure 700 to facilitate cooling of the user's head. The top portion 704 of the energy management structure 700 comprises a radial projection 782 that may be used to facilitate alignment and/or attachment of the pad structure 1400 to the top portion.

Figure 11B:
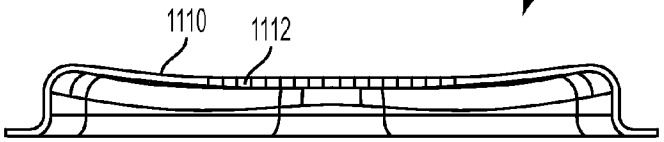
FIGS. 11A and 11B are perspective and cross sectional views of a pad structure according to an embodiment of the present application.
Figure 11A:
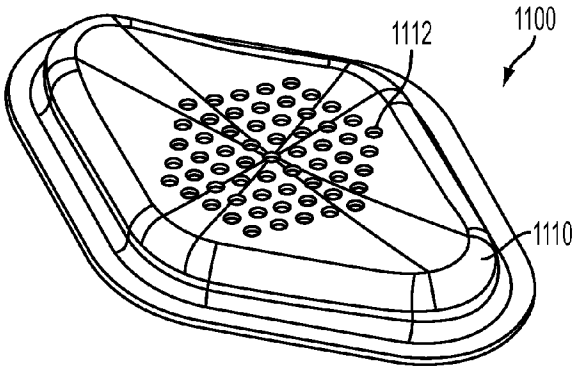
Figure 15A:
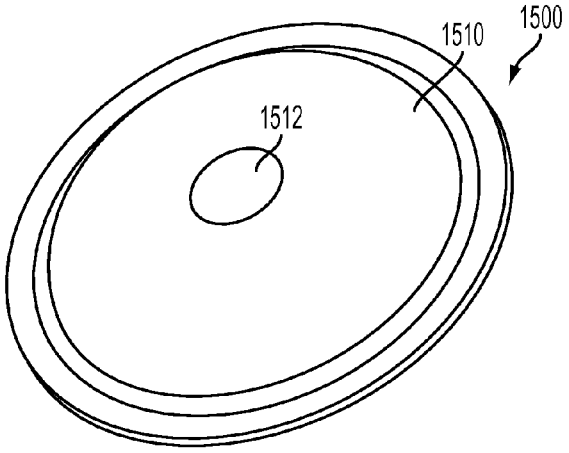
FIGS. 15A-15C are perspective views of pad structures according to embodiments of the present application.
Figure 15B:
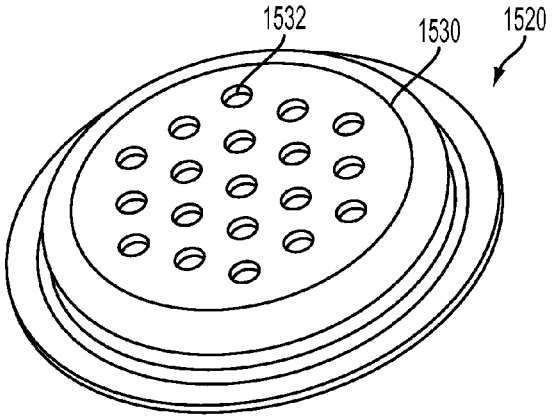
Figure 15C:
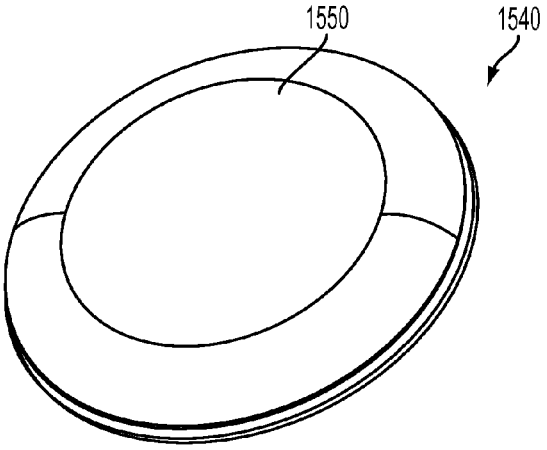

FIGS. 11A-11B and 15A-15C illustrate various embodiments of collapsible polymer pad structures according to embodiments of the present application. FIG. 15A illustrates a polymer pad structure 1500 having a collapsible, hemispherical body portion 1510 with a central opening 1512 that permits air flow into and out of the energy management structure. FIG. 15B illustrates a polymer pad structure 1520 having a collapsible, hemispherical body portion 1530 with a plurality of openings 1532 for air flow. FIG. 15C illustrates a polymer pad structure 1540 having a corrugated body portion 1550 that permits the structure to collapse during an impact event. FIGS. 11A-11B illustrate a diamond shaped polymer pad structure 1100 having a collapsible body portion 1110 with a plurality of centrally located openings 1112 that permit air flow into and out of the energy management structure 1000.

The pads of the present application generally have a thickness between about 0.050 inch and about 0.5 inch. For example, in one embodiment, the thickness of the pads are about 0.125 inch. Pads of various thicknesses may also be used to adjust the sizing and fit of the helmet on the user's head.

The pads may be attached to the energy management structures in a variety of ways and may or may not be removable from the structure. For example, the pads may be attached to the energy management structures with a friction or interference fit, one or more fasteners, Velcro®, adhesive, clips, pins, snaps, tape, buckles, or the like. Further, the pads may be integrally formed with the energy management structures or separately formed and RF welded to the structure. Other methods for fabricating and assembling the pads may also be used, such as, for example, ultrasonic, heat staking, co-molding, insert molding, thermoforming, or rotomolding.

Figure 16B:
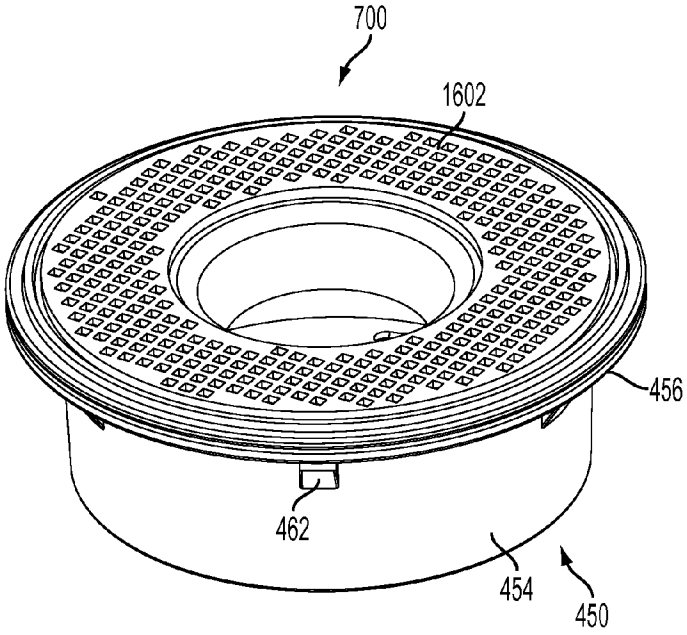
FIGS. 16A and 16B are bottom and top perspective views of an energy management structure according to an embodiment of the present application.
Figure 16A:
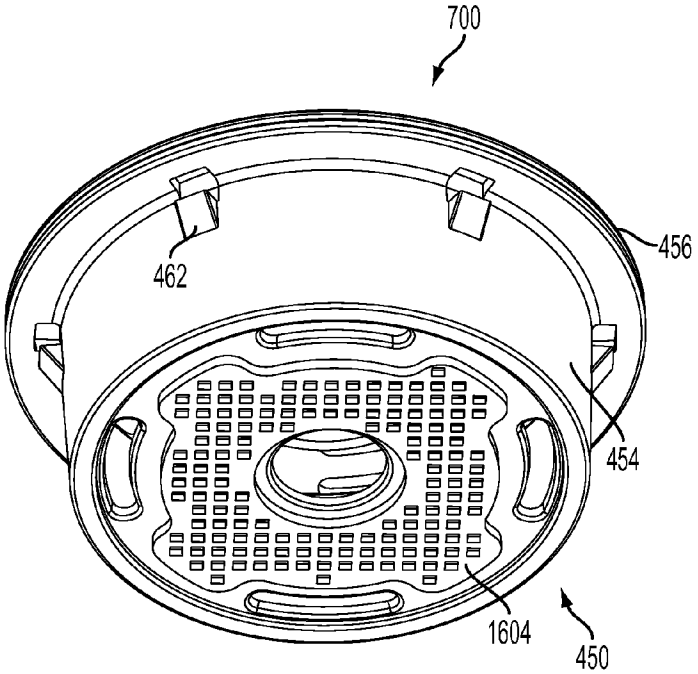
Figure 16C:
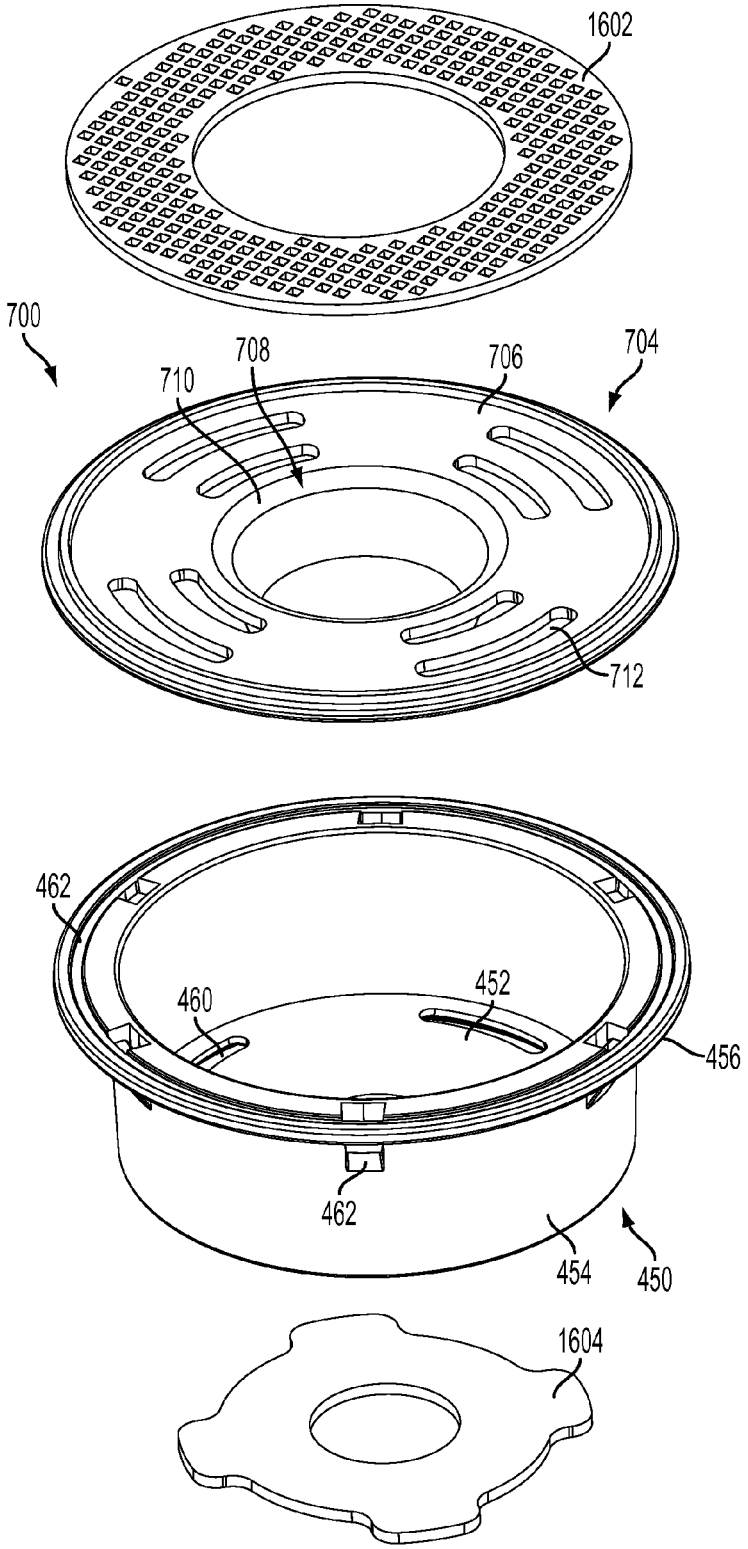
FIG. 16C is an exploded perspective view of the energy management structure of FIGS. 16A and 16B.

FIGS. 16A-16C illustrate attachment features 1602 and 1604 attached to the top portion 704 and the bottom portion 450 of the energy management structure 700. In certain embodiments, the attachment feature 1604 on the bottom portion 450 is used to removably attach the energy management structure, and often a corresponding carrier of the impact liner system, to the interior or backface of a helmet shell. As shown, the attachment feature 1604 is a piece of Velcro® (e.g., hook fabric or loop fabric) that is configured to mate with a corresponding piece of Velcro® (e.g., loop fabric or hook fabric) on the interior of the helmet shell to removably attach the energy management structure and generally the corresponding carrier to the helmet shell. However, a wide variety of other attachments features may be used to attach one or more of the energy management structures to the interior of the helmet shell. Examples of attachment features that may be used include, but are not limited to, one or more fasteners, adhesive, clips, pins, snaps, tape, buckles, hook and loop, or pin and slot. In certain embodiments, one or more of the energy management structures are attached to the interior of the helmet shell with the attachment feature but without being attached to a carrier of the impact liner system and/or without being connected to another energy management structure.

In certain embodiments, the attachment feature 1602 on the top portion 704 is used to removably attach one or more pads or other items to the energy management structure. As such, the pads may be configured to comfort various portions of the user's head and may be used to adjust the sizing and fit of the helmet on the user's head. Further, the pads may be positioned to alter or improve helmet performance in certain locations. As shown, the attachment feature 1602 is a piece of Velcro® (e.g., hook fabric or loop fabric) that is configured to mate with a corresponding piece of Velcro® (e.g., loop fabric or hook fabric) of the pad or other item to removably attach the pad or other item to the energy management structure. However, a wide variety of other attachments features may be used to attach one or more pads or other items to the energy management structure. Examples of attachment features that may be used include, but are not limited to, one or more fasteners, adhesive, clips, pins, snaps, tape, buckles, hook and loop, or pin and slot.

The stiffness response of the impact liner system of the present application may be modified or tuned in a variety of ways. For example, the energy management structures may be tuned to have a desired stiffness response. In certain embodiments, these structures may be tuned without regard to the comfort or wearability of the helmet due to the presence of the pads. The stiffness response of the energy management structures may be tuned in a variety of ways, such as by altering the size (e.g., diameter, height, etc.), shape (e.g., cross sectional shape), wall thickness, angle, draft, or type of material of one or more of the energy management structure components.

For example, the material and/or geometry of the energy management structures may be selected to provide various stiffness responses. As described above, the cylindrical vertical wall of the energy management structure provides an initial impact response and the vertical wall of the inner structure provides a secondary impact response. Further, the material of the energy management structure may be selected to "tune" the stiffness response. For example, a harder or softer material may be used to increase or decrease, respectively, the stiffness. Ribs may also be added to the walls of the energy management structure to increase the stiffness of the structure. The energy management structures may also be spaced or arranged to provide a desired stiffness response, e.g., rectangular, staggered, patterned, or circular arrangements.

Once the energy management structures are tuned to have a desired stiffness response, the pads may be tuned to provide a desired stiffness while still maintaining a degree of softness or comfort. For example, the type of material, density, thickness, shape, size, and configuration of the pads may be altered to provide more or less stiffness or comfort. As described above, the pads may be configured to provide an initial comfort response and the vertical walls of the energy management structure provides a secondary impact response, the secondary impact response being more stiff than the initial comfort response.

The impact liner system of the present application may also be adapted and configured in a variety of ways. For example, any one or more of the energy management structures may be removed from a carrier and replaced with a similar or different energy management structure, e.g., with an energy management structure having a different stiffness response. Further, the top portion of any one or more of the energy management structures may be removed from the base portion and replaced with a similar or different top portion. Still further, the bottom portion of any one or more of the energy management structures may be removed from the top portion and replaced with a similar or different bottom portion. In certain embodiments, the energy management structures may be configured to provide a rigid stiffness response when the threat is from high velocity impacts, such as ballistic or other high velocity impacts. In other embodiments, the energy management structures may be configured to provide a softer or less rigid stiffness response when the threat is from lower velocity impacts.

The impact liner system of the present application may also act as a ventilation system to cool the user's head. For example, as discussed above, the carriers, energy management structures, and/or pads may comprise openings or slots that permit air to circulate between the head of the user and the helmet shell to facilitate cooling of the user's head.

The words used in the claims have their full ordinary meaning and are not limited in any way by the description of the embodiments in the specification. Further, as described herein, when one or more components are described as being connected, joined, affixed, coupled, attached, or otherwise interconnected, such interconnection may be direct as between the components or may be in direct such as through the use of one or more intermediary components. Also as described herein, reference to a "member," "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, component geometries, shapes, and dimensions can be modified without changing the overall role or function of the components. Therefore, the inventive concept, in its broader aspects, is not limited to the specific details, the representative device, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. An impact liner system for a helmet, comprising:

a plurality of compressible energy management structures positioned between an interior surface of a helmet shell and the head of a user when the impact liner system is attached to the helmet shell, wherein each energy management structure comprises an outer wall and an inner wall substantially surrounded by the outer wall, wherein the outer and inner walls are configured to bend when the exterior of the helmet shell is impacted by an object; and one or more carriers for supporting the plurality of energy management structures within the helmet shell, the carrier comprising a plurality of openings, each opening configured to receive an energy management structure;

wherein the outer wall of the energy management structures extend between the interior of the helmet shell and the carrier of the impact liner system; and wherein each energy management structure comprises a top portion attached to a bottom portion, the top portion comprising the inner wall and a top wall and the bottom Portion comprising the outer wall and a bottom wall, and wherein the inner wall extends from the top wall toward the bottom wall and the outer wall extends between the bottom wall and the top wall.

2. The impact liner system of claim 1, wherein the outer wall of at least one energy management structure is cylindrical.

3. The impact liner system of claim 2, wherein the inner wall of the at least one energy management structure is cylindrical.

4. The impact liner system of claim 2, wherein the inner wall of the at least one energy management structure is conical.

5. The impact liner system of claim 1, wherein a bottom of the inner wall is spaced away from a bottom of the outer wall.

6. The impact liner system of claim 1, wherein the top wall comprises a central opening that at least partially forms the inner wall.

7. The impact liner system of claim 1, wherein the inner wall is conical and outer wall is cylindrical.

8. The impact liner system of claim 1, wherein the bottom wall and the top wall comprise one or more openings that permit air to escape from within the energy management structure during impact.

9. The impact liner system of claim 1, wherein a bottom of the inner wall is spaced away from the bottom wall and a bottom of the outer wall.

10. The impact liner system of claim 9, wherein the distance between the bottom of the inner wall and the bottom of the outer wall is between about 0.050 inch and about 0.75 inch.

11. The impact liner system of claim 1, wherein the top portion is removably attached to the bottom portion.

12. The impact liner system of claim 1, wherein the energy management structures are removably attached in the openings of the carrier.

13. The impact liner system of claim 1 further comprising one or more pads attached to one or more of the energy management structures and positioned between the energy management structure and the head of the user.

14. The impact liner system of claim 13, wherein the one or more pads comprise a compressible structure having a hemispherical body portion and are attached to a top wall of the one or more of the energy management structures.

15. The impact liner system of claim 13, wherein at least one energy management structure comprises an attachment feature for attaching the one or more pads to the energy management structure.

16. The impact liner system of claim 1, wherein at least one energy management structure comprises an attachment feature for removably attaching the energy management structure to the helmet shell.

17. An energy management structure for a helmet, comprising:

a bottom portion comprising a bottom wall and a cylindrical a outer wall extending from the bottom wall; and a top portion attached to the bottom portion, the top portion comprising a top wall and a conical inner wall extending from the top wall toward the bottom wall, wherein the outer wall extends between the bottom wall and the top wall; and wherein the energy management structure is configured to be positioned between the head of user and an interior surface of a helmet shell such that the top wall is adjacent the head of the user and the bottom wall is adjacent the interior surface of the helmet shell, and wherein the outer and inner walls are configured to bend when an exterior of the helmet shell is impacted by an object.

18. The energy management structure of claim 17 further comprising a compressible pad structure attached to the top wall and comprising a hemispherical body portion.

19. The energy management structure of claim 17, wherein the bottom wall and the top wall comprise one or more openings that permit air to escape from within the energy management structure during impact.

20. The energy management structure of claim 17, wherein a bottom of the inner wall is spaced away from the bottom wall and a bottom of the outer wall.

21. The energy management structure of claim 20, wherein the distance between the bottom of the inner wall and the bottom of the outer wall is between 0.05 inch and 0.75 inch.

22. The energy management structure of claim 17, wherein the top portion is removably attached to the bottom portion.

23. An energy management structure for a helmet, comprising:

a top wall comprising one or more openings;

a compressible inner wall extending from the top wall;

a compressible outer wall that substantially surrounds the inner wall; and a compressible pad structure attached to the top wall and comprising a hemispherical body portion;

wherein the energy management structure is configured to be positioned between the head of user and an interior surface of a helmet shell such that the compressible pad structure is adjacent the head of the user and a bottom of the outer wall is adjacent the interior surface of the helmet shell, and wherein the inner and outer walls are configured to bend when an exterior of the helmet shell is impacted by an object; and wherein the inner wall is conical and outer wall is cylindrical.

24. The energy management structure of claim 23, wherein a bottom of the inner wall is spaced away from a bottom of the outer wall.

25. The energy management structure of claim 23 further comprising a top portion attached to a bottom portion, wherein the top portion comprises the top wall and the inner wall and the bottom portion comprises the outer wall.

26. The energy management structure of claim 25 wherein the top portion is removably attached to the bottom portion.

* * * * *